US006052878A

United States Patent [19]

Allred et al.

[11] Patent Number: 6,052,878

[45] Date of Patent: Apr. 25, 2000

[54] METHODS AND APPARATUS FOR INTERLACING FILAMENTS AND METHODS OF MAKING THE APPARATUS

[75] Inventors: Kevin Lyle Allred, Chadds Ford, Pa.; Matthew Dewey Hubert, Columbia, S.C.; Maria Roxana Maksymowych, West Grove; Maurice Cornelius Todd, Chadds Ford, both of Pa.; Peter Veenema, Wilmington; Darwin Rex Wall, Middletown, both of Del.

[73] Assignee: E. I. du Pont de Nemours and Company, Wilmington, Del.

[21] Appl. No.: 09/321,701

[22] Filed: May 28, 1999

[51] Int. Cl.[7] ..... D02J 1/08

[52] U.S. Cl. ..... 28/274; 28/272; 28/252

[58] Field of Search ..... 28/252, 247, 271, 28/272, 273, 274, 275, 276; 57/208, 209, 289, 350, 908

[56] References Cited

U.S. PATENT DOCUMENTS

| | | | |
|---|---|---|---|
| 2,985,995 | 5/1961 | Bunting, Jr. et al. | 57/140 |
| 2,990,671 | 7/1961 | Bunting, Jr. et al. | 57/34 |
| 3,110,151 | 11/1963 | Bunting, Jr. et al. | 57/157 |
| 3,115,691 | 12/1963 | Bunting, Jr. et al. | 28/1 |
| 3,364,537 | 1/1968 | Bunting, Jr. et al. | 28/1 |
| 3,730,413 | 5/1973 | McDermott et al. | 28/275 |
| 4,069,565 | 1/1978 | Negishi et al. | 28/275 |
| 4,240,188 | 12/1980 | Zoina | 28/274 |
| 4,392,285 | 7/1983 | Stables et al. | 28/276 |
| 4,949,441 | 8/1990 | Ethridge | 28/271 |
| 5,010,631 | 4/1991 | Ritter | 28/274 |
| 5,079,813 | 1/1992 | Agers et al. | 28/274 |
| 5,146,660 | 9/1992 | Ritter | 28/274 |
| 5,481,787 | 1/1996 | Sano et al. | 28/276 |
| 5,713,113 | 2/1998 | Demir | 28/274 |
| 5,950,290 | 9/1999 | Sear | 28/272 |
| 5,964,015 | 10/1999 | Sear | 28/274 |

FOREIGN PATENT DOCUMENTS 0 564 400 A1 3/1993 European Pat. Off. ..... D02J 1/08

OTHER PUBLICATIONS

IMS Bulletin, *Interlacing Jets*, Document #133, Rev.–3, Sep. 1995, International Machinery Sales, Inc., Winston–Salem, North Carolina 27106–3218.

Fibreguide FG3, *Airjet Systems*, Undated, Fibreguide Ltd., Macclesfield, Cheshire SK10 1JE, England.

Handbook of Product Design For Manufacturing, *A Practical Guide to Low–Cost Production*, James G. Bralla, McGraw–Hill Book Company, pp. 4–189 –4–194, 1986.

*Primary Examiner*—Amy B. Vanatta
*Attorney, Agent, or Firm*—John E. Griffiths

[57] ABSTRACT

The present invention relates to fluid jet interlace apparatus and related methods for interlacing filaments into a yarn with the filaments intermingled with adjacent ones of the filaments and groups of the filaments to maintain unity of the yarn by frictional constraint between the filaments at periodic nodes along the yarn. The invention also relates to methods of making fluid jet interlace apparatus.

33 Claims, 11 Drawing Sheets

METHODS AND APPARATUS FOR INTERLACING FILAMENTS AND METHODS OF MAKING THE APPARATUS

BACKGROUND OF THE INVENTION

1. Field of the Invention

This invention relates to fluid jet interlace apparatus, and related methods, for interlacing filaments into a yarn with the filaments intermingled with adjacent ones of the filaments and groups of the filaments to maintain unity of the yarn by frictional constraint between the filaments at periodic nodes along the yarn. The invention also relates to methods of making fluid jet interlace apparatus.

2. Description of Related Art

Apparatus and processes for interlacing filaments entangle substantially parallel filaments of a spun yarn thereby periodically producing interlaced portions, knots or nodes in the yarn and substantially non interlaced portions in the yarn. This gives a coherence to the yarn similar to that of a twisted yarn despite the fact that there is hardly any twist, or no twist, in the yarn. Interlacing is now conventional for high speed spinning processes for producing multifilament yarns.

The interlacing of filaments in a yarn was first taught by W. W. Bunting, Jr., et al., in U.S. Pat. No. 2,985,995 which discloses interlace apparatuses having yarn passages with circular cross sections (FIG. 1 therein), rectangular or slot shaped cross sections (FIG. 5 therein) and oval cross sections (FIG. 22 therein).

Interlace apparatuses are commercially available from Fiberguide Ltd., with offices in Cheshire, England, and International Machinery Sales, Inc. (IMS), with offices in Winston Salem, N.C. USA, with yarn passages with various cross sections including triangular cross sections with substantially pointed corners.

U.S. Pat. No. 5,146,660 assigned to Heberlein Maschinenfabrik AG, discloses interlace apparatus having yarn passages with numerous alternative cross sections.

U.S. Pat. No. 5,079,813 assigned to E. I. du Pont de Nemours and Company discloses an interlace apparatus having yarn passages with slot shaped cross sections that flare outwardly from where they intersect air inlet passages.

Some prior art interlace apparatuses produce an insufficient number of interlaced nodes with adequate coherence strength.

Some fluid jet interlace apparatuses are less efficient and require more compressed fluid, typically gas, than other apparatuses, which adds to the cost of the final product. Obviously it is desirable to reduce the amount of fluid needed to produce an acceptable interlaced yarn thereby reducing the cost of the final product.

Certain interlace apparatuses suffer disadvantages associated with threading yarn into the apparatuses. Some apparatuses have a tendency to force fluid from the yarn passage out through the string up slot thereby hindering the feeding of the yarn through a string up slot into the yarn passage. U.S. Pat. No. 5,146,660 discloses apparatus designs to overcome this problem by having special corners built in the yarn passage which provide low pressure areas reducing the force of air out the string up slot.

It is desirable to provide suitable fluid jet interlace apparatuses, and associated methods of interlacing, and methods of manufacturing such apparatus, that solve or improve upon one or more of the above problems.

These and other objects of the invention will be clear from the following description.

SUMMARY OF THE INVENTION

A first aspect of the invention relates to an apparatus for interlacing filaments into a yarn with the filaments intermingled with adjacent ones of the filaments and groups of the filaments to maintain unity of the yarn by frictional constraint between the filaments at periodic nodes along the yarn, comprising:

a housing defining:

a chamber adapted to receive fluid;

a fluid inlet passage connected to receive fluid from the chamber; and a yarn passage connected to receive fluid from the fluid inlet passage, the yarn passage having a cross section perimeter, at least where the fluid inlet passage is connected to the yarn passage, having a shape selected from the group consisting of (i) a triangle having three rounded corners each independently with a radius r with r/R of about 0.50 to about 0.90 where R is a radius of a largest inscribed circle within the triangle, and the cross section perimeter being smooth or substantially smooth and having no discontinuities except where the fluid inlet passage is connected to the perimeter, (ii) a heart, and (iii) a pentagon.

The first aspect of the invention further relates to a related method for interlacing filaments into a yarn with the filaments intermingled with adjacent ones of the filaments and groups of the filaments to maintain unity of the yarn by frictional constraint between the filaments at periodic nodes along the yarn, comprising:

passing the yarn through a yarn passage defined by a housing, the yarn passage having a cross section perimeter, at least where the fluid inlet passage is connected to the yarn passage, having a shape selected from the group consisting of (i) a triangle having three rounded corners each independently with a radius r with r/R of about 0.50 to about 0.90 where R is a radius of a largest inscribed circle within the triangle, and the cross section perimeter being smooth or substantially smooth and having no discontinuities except where the fluid inlet passage is connected to the perimeter, (ii) a heart, and (iii) a pentagon;

directing a jet of fluid through the fluid inlet passage through the housing into the yarn passage against the yarn; and forming periodic nodes along the yarn where the filaments are intermingled with adjacent ones of the filaments and groups of the filaments to maintain unity of the yarn by frictional constraint between the filaments.

A second aspect of the invention is directed to an apparatus for interlacing filaments into a yarn with the filaments intermingled with adjacent ones of the filaments and groups of the filaments to maintain unity of the yarn by frictional constraint between the filaments at periodic nodes along the yarn, comprising:

a housing having:

a chamber adapted to receive fluid;

a fluid inlet passage connected to receive fluid from the chamber;

a yarn passage connected to receive fluid from the fluid inlet passage, the yarn passage having a fluid inlet side which connects with the fluid inlet passage and a non fluid inlet side opposed to the fluid inlet side;

an exterior surface defining an end of the non fluid inlet side of the yarn passage, the exterior surface being angled greater than 10° with respect to a longitudinal axis of the yarn passage providing an edge between the yarn passage and the exterior surface; and a guide surface having a groove wall defining a fluid guide groove, the groove wall coextensive with the fluid inlet side of the yarn passage, the groove wall diverging away from the longitudinal axis of the yarn passage, whereby fluid exiting the yarn passage flows away from the exterior surface and travels close to the groove wall thereby being drawn away from the longitudinal axis of the yarn passage.

The second aspect of the invention is further directed to a related method for interlacing filaments into a yarn with the filaments intermingled with adjacent ones of the filaments and groups of the filaments to maintain unity of the yarn by frictional constraint between the filaments at periodic nodes along the yarn, comprising:

passing the yarn through a yarn passage defined by a housing;

directing a jet of fluid through a fluid inlet passage through the housing into the yarn passage against the yarn, the directing step including guiding fluid exiting from the yarn passage past an exterior surface defining an end of a non fluid inlet side of the yarn passage, the exterior surface being angled greater than 10° with respect to a longitudinal axis of the yarn passage providing an edge between the yarn passage and the exterior surface;

drawing the fluid exiting from the yarn passage away from the longitudinal axis of the yarn passage towards a groove wall in a guide surface of the housing, the groove wall coextensive with a fluid inlet side of the yarn passage which connects with the fluid inlet passage, the groove wall diverging away from the longitudinal axis of the yarn passage; and forming periodic nodes along the yarn where the filaments are intermingled with adjacent ones of the filaments and groups of the filaments to maintain unity of the yarn by frictional constraint between the filaments.

A third aspect of the invention relates to an apparatus for interlacing filaments into a yarn with the filaments intermingled with adjacent ones of the filaments and groups of the filaments to maintain unity of the yarn by frictional constraint between the filaments at periodic nodes along the yarn, comprising:

a housing defining:

a chamber adapted to receive fluid;

a fluid inlet passage connected to receive fluid from the chamber;

a yarn passage connected to receive fluid from the fluid inlet passage; and a string up slot having an internal opening with a center plane which (i) intersects the yarn passage along an intersection line which is parallel, or substantially parallel, to the longitudinal axis of the yarn passage, (ii) intersects a fluid outlet end of the fluid inlet passage at a distance from the longitudinal axis of the fluid inlet passage between 0% and 80% of a radius of the fluid inlet passage, and (iii) intersects the fluid outlet end of the fluid inlet passage at an angle greater than 0° to less than 90° with respect to the longitudinal axis of the fluid inlet passage.

The third aspect is further directed to a method for interlacing filaments into a yarn with the filaments intermingled with adjacent ones of the filaments and groups of the filaments to maintain unity of the yarn by frictional constraint between the filaments at periodic nodes along the yarn, comprising:

feeding the yarn through a string up slot through a housing into a yarn passage in the housing, such that the yarn follows a string up path which:

(i) enters the yarn passage along an intersection line which is parallel, or substantially parallel, to a longitudinal axis of the yarn passage, (ii) intersects a fluid outlet end of a fluid inlet passage at a distance from a longitudinal axis of the fluid inlet passage between 0% and 80% of a radius of the fluid inlet passage, and (iii) intersects the fluid outlet end of the fluid inlet passage at an angle greater than 0° to less than 90° with respect to the longitudinal axis of the fluid inlet passage;

during the feeding step, directing a jet of fluid through the inlet passage through the housing into the yarn passage against the yarn, such that the jet of fluid forces the yarn from the thread up slot, pushes the yarn into the yarn passage, and inhibits the yarn from coming back out the thread up slot;

passing the yarn through the yarn passage; and forming periodic nodes along the yarn where the filaments are intermingled with adjacent ones of the filaments and groups of the filaments to maintain unity of the yarn by frictional constraint between the filaments.

A fourth aspect of the invention is directed to a method for making an apparatus for interlacing filaments into a yarn with the filaments intermingled with adjacent ones of the filaments and groups of the filaments to maintain unity of the yarn by frictional constraint between the filaments at periodic nodes along the yarn, comprising:

forming in a housing;

a chamber adapted to receive fluid;

a fluid inlet passage connected to receive fluid from the chamber; and a pilot passage connected to receive fluid from the fluid inlet passage, the pilot passage having a longitudinal axis;

positioning an electric discharge wire through the pilot passage and passing current through the wire;

providing a dielectric fluid in the pilot passage; and eroding the housing by moving the wire with respect to the housing and parallel to, or substantially parallel to, the longitudinal axis of the pilot passage forming the pilot passage into a yarn passage having a cross section perimeter, at least where the fluid inlet passage is connected to the yarn passage, having a shape selected from the group consisting of (i) a triangle having three rounded corners each independently with a radius r with r/R of about 0.50 to about 0.90 where R is a radius of a largest inscribed circle within the triangle, and the cross section perimeter being smooth or substantially smooth and having no discontinuities except where the fluid inlet passage is connected to the perimeter, (ii) a heart, and (iii) a pentagon.

BRIEF DESCRIPTION OF THE DRAWINGS

The invention can be more fully understood from the following detailed description thereof in connection with accompanying drawings described as follows.

DESCRIPTION OF THE PREFERRED EMBODIMENT(S)

Figure 1:
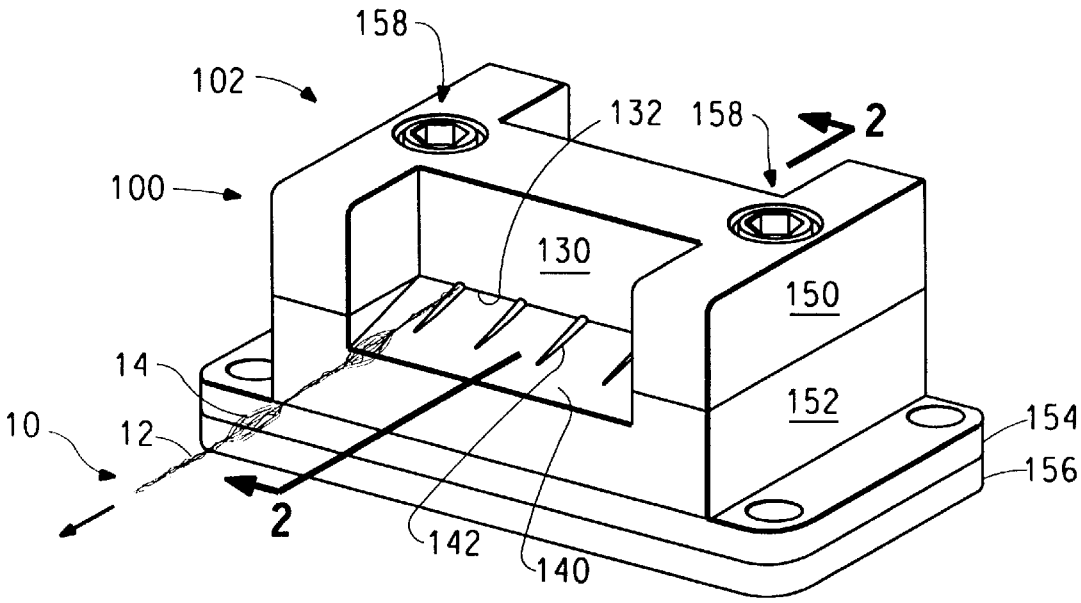
FIG. 1 is a perspective view of a first embodiment of an interlacing apparatus for interlacing filaments into a cohesive yarn in accordance with the invention.

Throughout the following detailed description, similar reference characters refer to similar elements in all figures of the drawings.

Referring to FIG. 1, the invention is directed to fluid jet interlace apparatus 100 and related methods for interlacing filaments into a yarn 10 with the filaments intermingled with adjacent ones of the filaments and groups of the filaments to maintain unity of the yarn 10 by frictional constraint between the filaments at periodic nodes 12 along the yarn 10. The invention is also directed to methods of making fluid jet interlace apparatus.

The nodes 12 are separated by non-interlaced portions 14 of the yarn where the filaments are substantially not intermingled or entangled with respect to one another. The filaments in the non-interlaced portions 14 can be separated from one another as shown exaggerated in FIG. 1.

Interlacing, also known as intermingling or entangling, is often employed in the fiber industry. Multifilament yarns 10 are interlaced to provide nodes 12 or points of entanglement (close contact or compaction) among the filaments and extending along the length of the yarn 10. Generally, an optimal mean distance between nodes 12 is sought for any particular multifilament yarn product.

The nodal structure or interlace is introduced to multifilament yarns 10 by means of a fluid jet interlace apparatus. The mean distance between nodes 12 along the length of the interlaced yarn 10 is controlled primarily by 3 variables of the interlace process. These variables are: the geometry of the interlace jet assembly, the yarn tension and speed of entry into the interlace jet assembly, and the volume of fluid (pressure of the air or other gas) introduced to the jet assembly. Process parameters selected for interlacing yarn are adapted according to use, as is known in the art, and depend on the yarn denier, number of filaments, and fiber finishes (lubricant) applied to the yarn. Practical operational experience determines the parameters providing the desired level of entanglement and mean distance between nodes 12 along the length of the interlaced yarn 10.

Modern yarn entanglement testing is performed with commercially available equipment like that supplied by Rothschild Measurement Instruments, Switzerland (Traubenstrasse 3, 8002 Zuerich, Schweiz). The Rothschild R2040 or the R2071/72 are suitable automated instruments for characterizing the nodal structure of yarn entanglements introduced by the interlace jet assemblies disclosed herein.

Filaments

Filaments that can be interlaced by the fluid jet interlace apparatus and methods of this invention are defined as relatively flexible, macroscopically homogeneous bodies having a high ratio of length to width across their cross-sectional area perpendicular to their length. The filament cross section can be any shape, but is frequently circular. Herein, the term "fiber" is used interchangeably with the term "filament".

The fluid jet interlace apparatus and methods can be used to interlace any type of filaments. The filaments can be made of any and all types of synthetic or natural materials including homopolymers, copolymers, non-polymers, and mixtures thereof. Suitable synthetic polymers are polyamides, polyaromatic amides, polyolefins, polyketones, polyesters, polyetheresters, polyurethanes, polyacrylics, polyacetals, polylactones, polylactamides, polyacetate, polyvinylacetate, polyvinylidene, viscose rayon. Suitable natural fibers include cotton, cellulose, silk, ramie, jute, and hemp. Illustrative non-polymer fiber materials include glass and metals.

Aspects of the Invention

In a first aspect of the invention, the fluid jet interlace apparatus comprises a unique and unobvious combination of a housing defining a chamber, a fluid inlet passage, and a yarn passage having one of several specified cross section perimeter shapes. The first aspect includes a method of interlacing yarn which can be performed by using the interlace apparatus of the first aspect of the invention. In a second aspect of the invention, the fluid jet interlace apparatus comprises a unique and unobvious combination of the housing defining a chamber, a fluid inlet passage, a yarn passage, and structure which draws fluid exiting the yarn passage away from a longitudinal axis of the yarn passage. The second aspect includes a method of interlacing yarn which can be performed by using the interlace apparatus of the second aspect of the invention. In a third aspect of the invention, the fluid jet interlace apparatus comprises a unique and unobvious combination of a housing defining a chamber, a fluid inlet passage, a yarn passage, and a string up slot. The third aspect includes a method of interlacing yarn which can be performed by using the interlace apparatus of the third aspect of the invention. A fourth aspect of the invention is a method of making any one of the inventive interlace apparatuses. Further, each of these apparatuses can be combined with any one or more element and/or feature disclosed herein whether or not such element or feature is disclosed in relation to a different aspect of the invention.

Similarly, each of the methods of the invention can include any one or more step and/or feature disclosed herein whether or not such step or feature is disclosed in relation to a different aspect of the invention.

First Apparatus Embodiment

Figure 2:
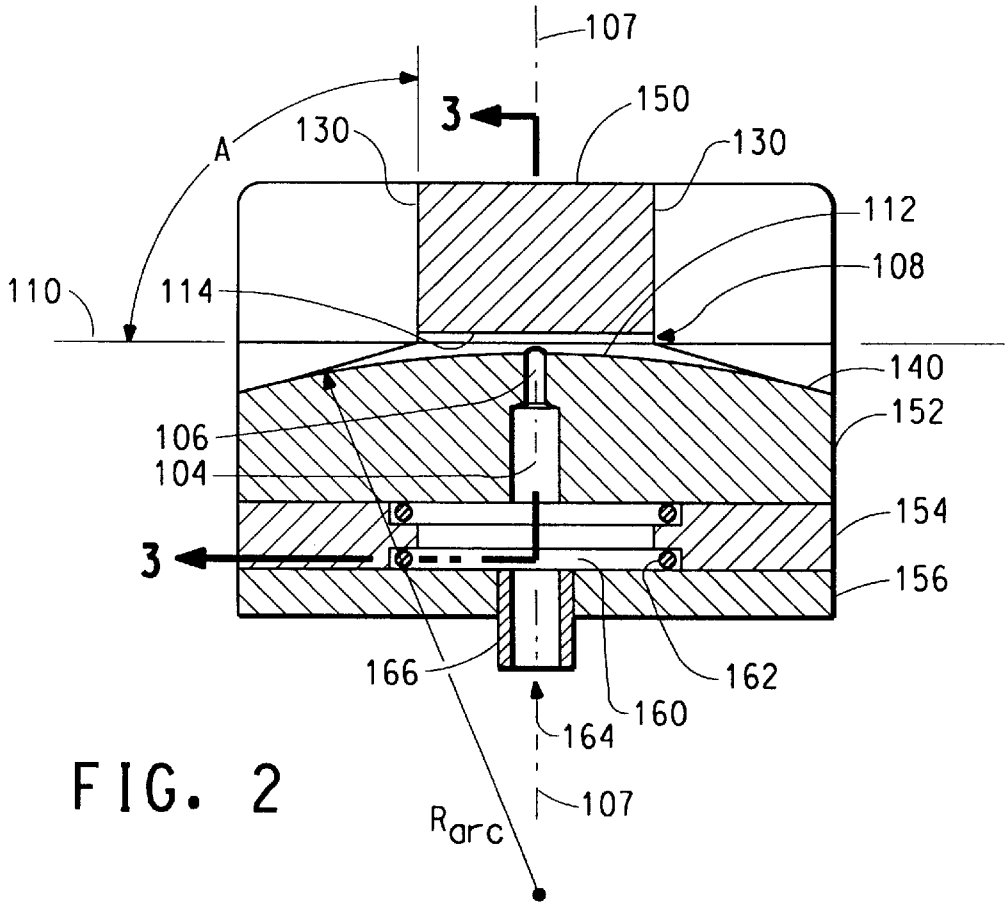
FIG. 2 is a cross sectional view through line 2—2 in FIG. 1 in the direction of the arrows.

Each of the first, second and third aspects of the invention are illustrated in a first embodiment of the fluid jet interlace apparatus 100 which is depicted in FIGS. 1 and 2. Referring to these Figures, the fluid jet interlace apparatus 100 comprises a housing 102 defining a chamber 104, a fluid inlet passage 106 having a longitudinal axis 107, and a yarn passage 108 having a longitudinal axis 110. The chamber 104 is adapted to receive fluid. The fluid inlet passage 106 is connected to receive fluid from the chamber 104. The yarn passage 108 is connected to receive fluid from the fluid inlet passage 106. A ratio ($A_{YP}/A_{FIP}$) of an area ($A_{YP}$) of the yarn passage 108 perpendicular to its longitudinal axis 110 to an area ($A_{FIP}$) of the fluid inlet passage 106 perpendicular to its longitudinal axis 107 where it connects with the yarn passage 108 is not critical, but it can be about 1 to about 3. The ratio ($A_{YP}/A_{FIP}$) of 1.8 was used in the Examples herein. The yarn passage 108 is defined by a wall having a fluid inlet side 112 which connects with the fluid inlet passage 106 and a non-fluid inlet side 114 opposed to the fluid inlet side 112. The fluid inlet passage 106 is defined by a cylindrical wall which connects with a center portion of the yarn passage 108 such that the yarn passage 108 extends past the fluid inlet passage 106 in both directions a distance of at least about three times the diameter of the fluid inlet passage 106 perpendicular to its longitudinal axis 107.

The longitudinal axis 110 of the yarn passage 108 is a straight line passing through a centroid of the yarn passage 108 where the fluid inlet passage 106 connects with the yarn passage 108. In the embodiment of FIGS. 1 and 2, the longitudinal axis 110 is parallel to longitudinal lines contained within the non-fluid inlet side 114 of the yarn passage 108. Similarly, the longitudinal axis 107 of the fluid inlet passage 106 is a straight line passing through a centroid of the fluid inlet passage 106. Preferably, the longitudinal axis 110 of the yarn passage 108 intersects the longitudinal axis 107 of the fluid inlet passage 106.

Preferably, the housing 102 defines a plurality of the chambers 104, a plurality of the air inlet passages 106, and a plurality of the yarn passages 108. The housing in FIG. 1 has four chambers 104, four air inlet passages 106, and four yarn passages 108. Each chamber 104 is connected to receive fluid. Each fluid inlet passage 106 is connected to receive fluid from an associated one of the chambers 104. Each yarn passage 108 is connected to receive fluid from an associated one of the fluid inlet passages 106. The fluid can be a gas (e.g., air) or liquid (e.g., water) or a combination thereof.

Figure 3A:
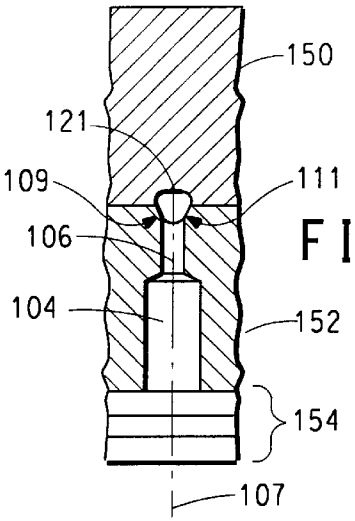
FIGS. 3A–3F are cross sectional views through line 3—3 in FIG. 2 in the direction of the arrows showing yarn passages with cross section perimeters being shaped as a triangle with rounded corners, an oval, a heart, a pentagon, a circle and a square, respectively.
Figure 3B:
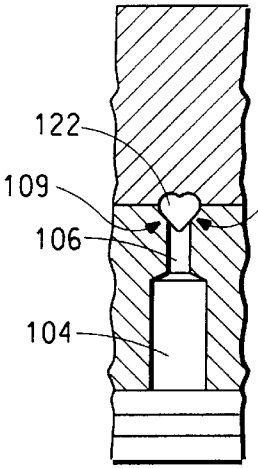
Figure 3C:
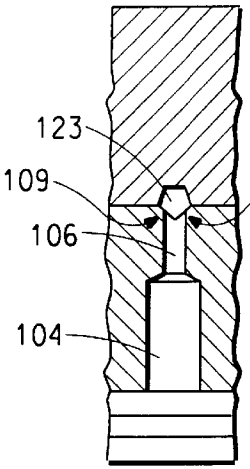

In the first aspect of the invention, each yarn passage 108 has a cross section perimeter 121–123, at least where the fluid inlet passage 106 is connected to the yarn passage 108, having a shape independently selected from the group consisting of (i) a triangle having three rounded corners (see FIG. 3A) each independently with a radius r with r/R of about 0.50 to about 0.90, and preferably of about 0.75 to about 0.85, where R is a radius of a largest inscribed circle within the triangle and the cross section perimeter is smooth or substantially smooth and has no discontinuities except where the fluid inlet passage 106 is connected to the perimeter 121–123, (ii) a heart (see FIG. 3B), and (iii) a pentagon (see FIG. 3C). Each yarn passage 108 has the selected cross section perimeter shape at least where the fluid inlet passage intersects the yarn passage. The selected cross section perimeter shape can extend through the entire yarn passage, but the cross section perimeter shape in end portions of the yarn passage can vary, such as will be described later.

Preferably, when the cross section perimeter shape 121 is a triangle, the triangle is an isosceles triangle with two sides of equal or substantially equal length, both contacting the fluid inlet passage 106. More preferably, the triangle is, or is substantially, an equilateral triangle having 3 sides of equal length, or substantially equal length. When the sides of the triangle have equal lengths or substantially equal lengths, the rounded corners have radiuses that are the same or substantially the same. However, the sides of the triangle can have lengths which are different from one another and/or the rounded corners can have radiuses that are different than one another. Preferably, one or more of the sides of the triangle are straight, slightly concave, or slightly convex.

In FIGS. 3A–3F, the cross section perimeter shapes 121–126 for the yarn passage 108 each have a vertical plane of symmetry containing the longitudinal axis 110 of the yarn passage 108 and the longitudinal axis 107 of the fluid inlet passage 106. From the orientation illustrated in FIGS. 3A–3F, the plane of symmetry extends through the length of the yarn passage 108 dividing space into a right half and a left half on either side of the plane of symmetry. In the first embodiment, the perimeter shape on the right side of the plane is a mirror image of the perimeter shape on the left side. In the cross sections illustrated in FIGS. 3A–3F, two intersection points 109, 111 exist where the wall defining the fluid inlet passage 106 intersects the fluid inlet side 112 of the wall defining the yarn passage 108. These two intersection points 109, 111 define a first portion or segment of the yarn passage perimeter shape 121 entirely defined by the wall defining the yarn passage 108 and a second portion or segment of the yarn passage perimeter shape 121 defined by fluid outlet end of the fluid inlet passage 106. It is the first portion defined by the wall defining the yarn passage 108 that is smooth or substantially smooth and without any discontinuities.

Since the yarn passage cross section perimeter, at least where the fluid inlet passage 106 connects with the yarn passage 108, is smooth or substantially smooth, has no discontinuities, and has no other corners except where the fluid inlet passage 106 is connected to the yarn passage 108, there aren't unnecessary corners or edges which might catch the filaments and there aren't unnecessary low pressure areas built into the design, such as where the string up slot intersects the yarn passage. When used, there are fewer secondary vortexes created in the fluid flow patterns in the apparatuses of the invention versus prior art having extra corners and/or discontinuities. As a result, the invention results in greater efficiency and use of less energy for similar or better results.

By the term "heart" shaped is meant any shape resembling a heart with opposed ear shaped lobes preferably symmetric about an axis of symmetry. The heart has two corners generally on the axis of symmetry, both pointing in the same direction. The corners can be sharp or slightly rounded.

When the cross section perimeter shape 123 is a pentagon, its five corners can be sharp or slightly rounded.

In the second aspect of the invention, the housing 102 defines an exterior surface 130 and a guide surface 140. The exterior surface 130 defines an end of at least the non-fluid inlet side 112 of the yarn passage 108. The exterior surface 130 is angled (at an angle A) greater than 10° with respect to the longitudinal axis 110 of the yarn passage 108 providing an edge 132 between the yarn passage 108 and the exterior surface 130. In this first embodiment, the angle A is 90°. The guide surface 140 has a groove wall 142 defining a fluid guide groove. The groove wall 142 is coextensive with the fluid inlet side 112 of the yarn passage 108. The groove wall 142 diverges away from the longitudinal axis 110 of the yarn passage 108. The divergent groove wall 142 can be angled or arced away from the longitudinal axis 110. If angled, the groove wall 142 is at an angle of 0.5° to 10° with respect to the longitudinal axis 110 of the yarn passage 108. If arced, the radius $R_{ARC}$ of the arc is from about 1 inch to about 10 inches (about 2.54 cm to about 25.40 cm), and preferably from about 4 inches to about 6 inches (about 10.16 cm to about 15.24 cm). If the groove wall 142 is arced, the fluid inlet side 112 of the yarn passage 108 can be arced at the same radius as the groove wall 142. The groove wall 142 has a length at least about 3, and preferably at least about 6, times the diameter of the fluid inlet passage 106 where it connects with the yarn passage 108. In operation, fluid exiting the yarn passage 108 flows away from the exterior surface 130 and travels close to the groove wall 142 thereby being drawn away from the longitudinal axis 110 of the yarn passage 108. The fluid exiting the yarn passage 108 exhibits a Coanda effect which is the tendency of a gas or liquid coming out of a jet to travel close to a contour of a wall even if the wall's direction or curvature is away from the axis of the jet.

Preferably, the housing 102 defines two exterior surfaces 130 and two guide surfaces 140. A first one of the exterior surfaces 130 and a first one of the guide surfaces 140 define the first end of the yarn passage 108. A second one of the exterior surfaces 130 and a second one of the guide surfaces 140 define a second end of the yarn passage 108. As such, in operation, fluid exiting each end of the yarn passage 108 flows away from the exterior surfaces 130 and travels close to the groove walls 142 of the guide surfaces 140 thereby being drawn away from the longitudinal axis 110 of the yarn passage 108. When the fluid is drawn away from the longitudinal axis 110, the fluid exerts a drawing force on the yarn in the opposite direction of the force on the yarn of the fluid entering the fluid inlet passage 106. Thus, the drawing force on the yarn caused by the fluid being drawn away from the longitudinal axis has the effect of drawing the yarn towards the fluid inlet side 112 thereby centering the yarn within the yarn passage 108.

The housing 102 can be made of one or more integral part. As illustrated in FIGS. 1 and 2, the parts can include a cap 150, a body 152, a manifold member 154, and a manifold cover 156. The body 152 defines the chambers 104, the fluid inlet passages 106 and the fluid inlet sides 112 of the yarn passages 108. The cap 150 defines the non-fluid inlet sides 114 of the yarn passages 108. The parts can be secured to one another by any means including welding, one or more adhesive, or fasteners (e.g., nut and bolt assemblies 158).

The manifold member 154 defines a space 160 for receiving fluid and which connects, for distributing fluid, to each of the chambers 104. Sealing members such as o-rings 162 are positioned in the space 160 to prevent leakage of fluid between the parts. The manifold cover 156 defines an opening 164 for receiving fluid and connects to deliver fluid to the space 160. A tube 166 can be attached to the manifold cover 156 and extend from the opening 164 for attaching to an end of hose (not depicted) where the other end of the hose is attached to a fluid source (not depicted).

Second Apparatus Embodiment

Each of the first, second and third aspects of the invention are illustrated in a second embodiment of the apparatus 200 depicted in FIGS. 4–11. Elements in the second embodiment that are similar to elements in the first embodiment are designated by numbers that are increased by 100 with respect to the elements in the first embodiment. Referring to these Figures, the apparatus 200 comprises a housing 202 which includes at least a jet assembly 203. The jet assembly 203 defines a chamber 204, a fluid inlet passage 206 having a longitudinal axis 207, and a yarn passage 208 having a longitudinal axis 210. The chamber 204 is adapted to receive fluid. The fluid inlet passage 206 is connected to receive fluid from the chamber 204. The yarn passage 208 is connected to receive fluid from the fluid inlet passage 206. The yarn passage 208 also has a fluid inlet side 212 which connects with the fluid inlet passage 206 and a non-fluid inlet side 214 opposed to the fluid inlet side 212.

Figure 7A:
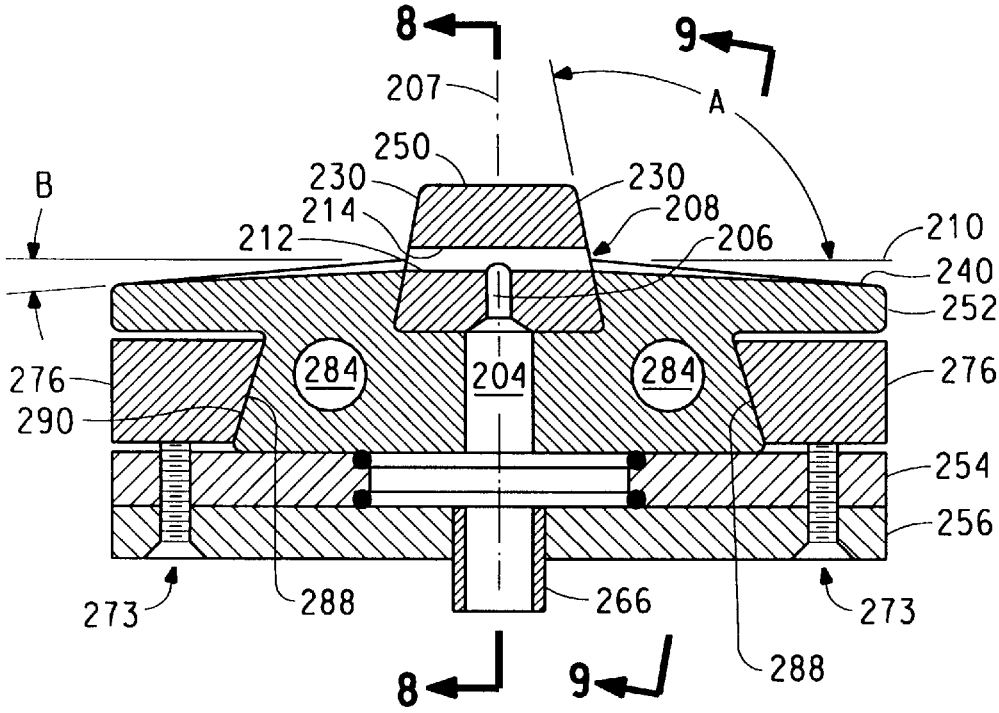
FIGS. 7A and 7B are first and second embodiments, respectively, of cross sectional views through line 7—7 in FIG. 5 in the direction of the arrows.
Figure 7B:
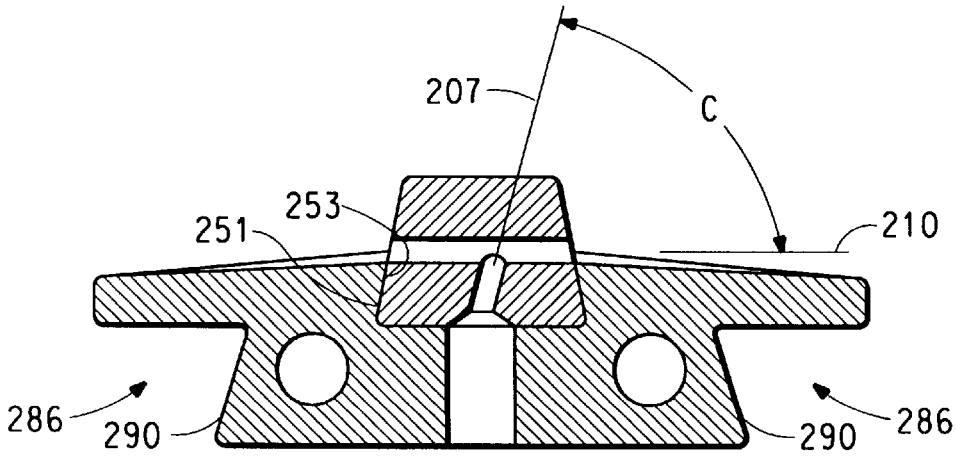
Figure 8:
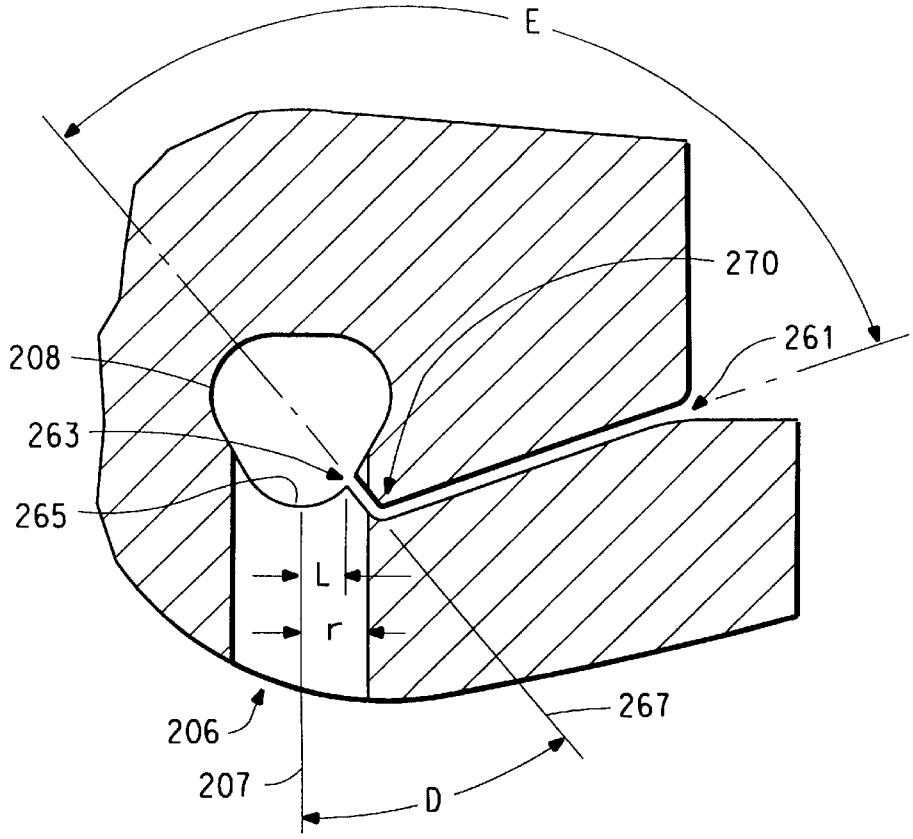
FIG. 8 is a cross sectional view through line 8—8 of the assembly shown in FIG. 7A in the direction of the arrows.
Figure 9:
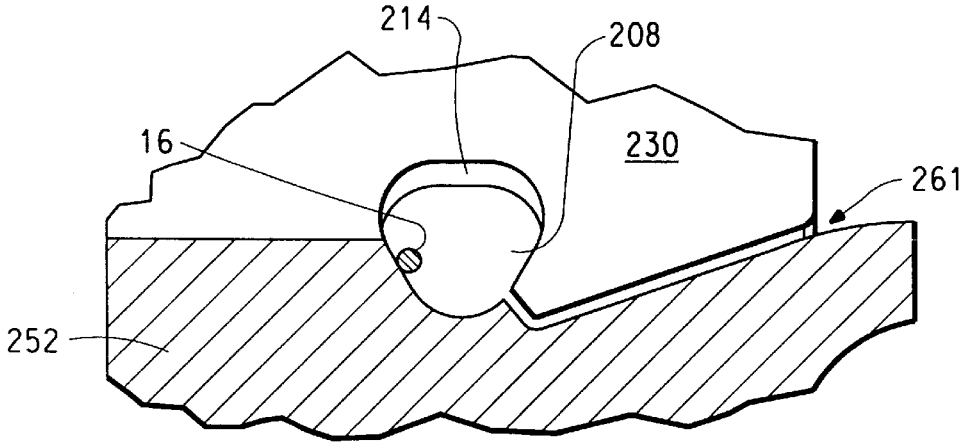
FIG. 9 is a cross sectional view through line 9—9 of the assembly shown in FIG. 7A in the direction of the arrows which are parallel to longitudinal lines in groove walls in a guide surface.
Figure 10:
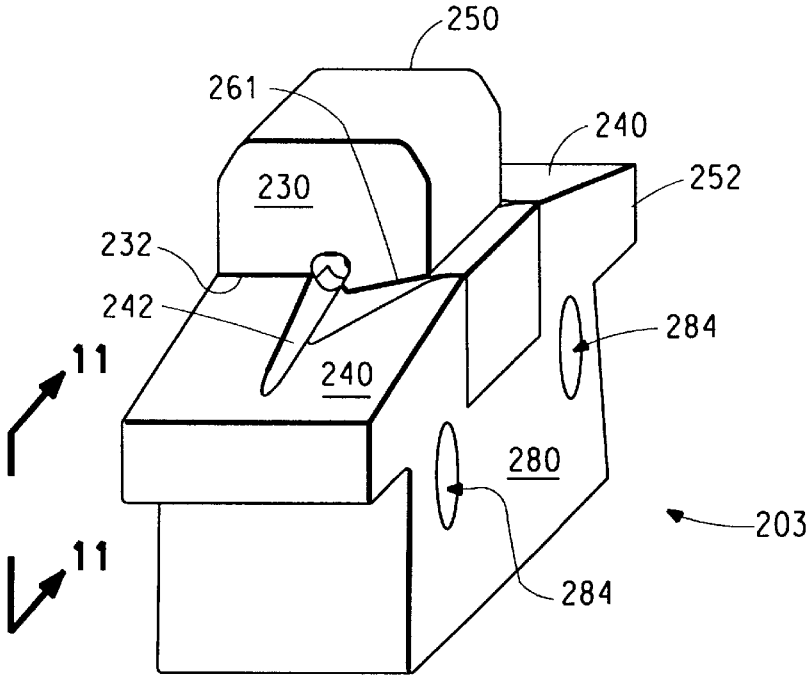
FIG. 10 is a perspective view of one cap and base assembly of the interlacing apparatus of FIG. 4.

Referring to FIG. 7A, the longitudinal axis 207 of the fluid inlet passage 206 can intersect the longitudinal axis 210 of the yarn passage 208 with the longitudinal axis of the fluid inlet passage 206 at or substantially at 90° with respect to the longitudinal axis 210 of the yarn passage. Alternatively, as shown in FIG. 7B, the longitudinal axis 207 of the fluid inlet passage 206 can intersect the longitudinal axis 210 of the yarn passage 208 with the longitudinal axis 207 of the fluid inlet passage 206 at an angle C of about 30° to about 90°, preferably of about 70° to about 80°, with respect to the longitudinal axis 210 of the yarn passage.

Preferably, the housing 202 includes a plurality of the jet assemblies 203. Each jet assembly 203 defines one of the chambers 204, one of the air inlet passages 206, and one of the yarn passages 208. Each chamber 204 is connected to receive fluid. Each fluid inlet passage 206 is connected to receive fluid from an associated one of the chambers 204. Each yarn passage 208 is connected to receive fluid from an associated one of the fluid inlet passages 206.

According to the first aspect of the invention, each yarn passage 208 has a cross section perimeter 121–123 , at least where the fluid inlet passage 106 is connected to the yarn passage 108, having a shape independently selected from the group consisting of (i) a triangle having three rounded corners each independently with a radius r with r/R of about 0.50 to about 0.90, and preferably of about 0.75 to about 0.85, where R is a radius of a largest inscribed circle within the triangle, and the cross section perimeter being smooth or substantially smooth and having no discontinuities except where the fluid inlet passage 206 is connected to the perimeter 121–123 , (ii) a heart, and (iii) a pentagon.

Figure 11:
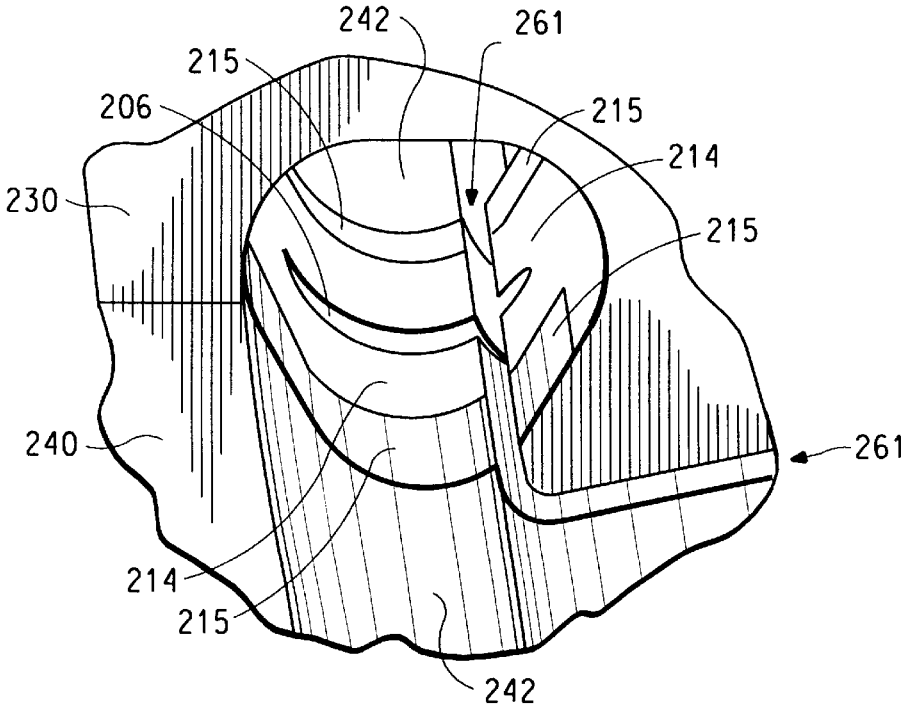
FIG. 11 is an enlarged perspective view along line 11—11 in the direction of the arrows looking through the yarn passage of the assembly depicted in FIG. 10.

According to the second aspect of the invention, each jet assembly 203 of the housing 202 defines an exterior surface 230 and a guide surface 240. See FIGS. 7A and 7B. The exterior surface 230 defines an end of the non-fluid inlet side 212 of the yarn passage 208. The exterior surface 230 is angled (at an angle A) greater than 10° with respect to the longitudinal axis 110 of the yarn passage 108 providing an edge 232 between the yarn passage 208 and the exterior surface 230. In this second embodiment, the angle A is 95°. See FIGS. 7A, 7B and 10. The guide surface 240 has a groove wall 242 defining a fluid guide groove. The groove wall 242 is coextensive with the fluid inlet side 212 of the yarn passage 208. The groove wall 242 diverges (e.g., is angled or arced) away from the longitudinal axis 210 of the yarn passage 208. If angled, the groove wall 242 is at an angle B from 0.5° to 10° with respect to the longitudinal axis 210 of the yarn passage 208. If arced, the radius $R_{ARC}$ of the arc is from about 1 inch to about 10 inches (about 2.54 cm to about 25.40 cm), and preferably from about 4 inches to about 6 inches (about 10.16 cm to about 15.24 cm). Like apparatus 100, the groove wall 242 has a length at least about 3, and preferably at least about 6, times the diameter of the fluid inlet passage 106 where it intersects the yarn passage 208. Referring to FIG. 11, each end of the yarn passage 208 can have a portion 215 of the fluid inlet side 212 of the yarn passage 208 that diverges (e.g., is angled or arced) away from the longitudinal axis 210 of the yarn passage 208 in the same manner that the groove wall 242 diverges (e.g., is angled or arced) away from the longitudinal axis 210. Similar to the operation of apparatus 100, operation of apparatus 200 is as follows. Fluid exiting the yarn passage 208 flows away from the exterior surface 230 and travels close to the groove wall 242 thereby being drawn away from the longitudinal axis 210 of the yarn passage 208. Again like apparatus 100, the fluid exiting the yarn passage 208 of apparatus 200 exhibits a Coanda effect.

Preferably, the housing 202 defines two exterior surfaces 230 and two guide surfaces 240. A first one of the exterior surfaces 230 and a first one of the guide surfaces 240 define the first end of the yarn passage 208. A second one of the exterior surfaces 230 and a second one of the guide surfaces 240 define a second end of the yarn passage 208. As such, in operation, fluid exiting each end of the yarn passage 208 flows away from the exterior surfaces 230 and travels close to the groove walls 242 of the guide surfaces 240 thereby being drawn away from the longitudinal axis 210 of the yarn passage 208. When the fluid is drawn away from the longitudinal axis 210, the fluid exerts a drawing force on the yarn in the opposite direction of the force on the yarn of the fluid entering the fluid inlet passage 206. Thus, the drawing force on the yarn caused by the fluid being drawn away from the longitudinal axis has the effect of drawing the yarn towards the fluid inlet side 212 thereby centering the yarn within the yarn passage 208.

According to the third inventive aspect, with respect to each jet assembly 203, the housing 202 defines a string up slot 261. See, in particular, FIGS. 8–11. The slot 261 has an internal opening 263 into the yarn passage 208. The opening 263 has a center plane 267 perpendicular to the opening 263 and bisecting the opening 263 along its longitudinal direction. The center plane 267 (i) intersects the yarn passage 208 along an intersection line which is parallel, or substantially parallel, to the longitudinal axis 210 of the yarn passage 208, (ii) intersects a fluid outlet end 265 of the fluid inlet passage 206 at a distance L from the longitudinal axis 207 of the fluid inlet passage 206 between 0% and 80%, preferably between 25% and 80%, and more preferably from about 50% to about 75%, of a radius r of the fluid inlet passage 206, and (iii) intersects the fluid outlet end 265 of the fluid inlet passage 206 at an angle D greater than 0° to less than 90°, and preferably greater than 20° to less than 40°, with respect to the longitudinal axis 207 of the fluid inlet passage 206.

The string up slot 261 includes an angled portion 270 wherein the slot 261 changes direction from the center plane 267 by an angle E at least about 60° and the angled portion 270 does not intersect the fluid inlet passage 206.

The housing 202 can be made of one or more integral part. As illustrated in FIGS. 4–11, the housing parts can include parts of the plurality of jet assembles 203, a manifold member 254, and a manifold cover 256. The parts of each jet assembly 203 includes a cap 250 and a body 252. The body 252 defines the chamber 204. The cap 250 defines the air inlet passage 206 and the yarn passage 208. It should be apparent, however, that the chamber 204 can extend into the cap 250 or the fluid inlet passage 206 can extend into the body 252. The cap 250 and the body 252 can be made of the same or different materials. For instance, both the cap 250 and the body 252 can be made of stainless steel or the body 252 can be made of stainless steel and the cap 250 can be made of a harder material, such as tungsten carbide. The cap 250 can be secured to the body 252 by any means including welding, one or more adhesive, and/or fasteners (e.g., nut and bolt assemblies). Alternatively or in addition, FIGS. 7A and 7B illustrate the cap 250 and body 252 being joined by a dove tail connection. The body 252 defines a female dove tail groove 253. The cap 250 defines a mating male dove tail projection or insert 251 for insertion into the dovetail groove 253 to hold the cap 250 and the body 252 together. Alternatively, the body 252 can have a dove tail insert for insertion in a mating female dove tail groove in the cap 250.

The manifold member 254 defines a space 260 for receiving fluid and which connects, for distributing fluid, to each of the chambers 204. Sealing members such as o-rings 262 are positioned in the space 260 to prevent leakage of fluid between the parts. The manifold cover 256 defines an opening 264 for receiving fluid and connects to deliver fluid to the space 260. A tube 266 can be attached to the manifold cover 256 and extend from the opening 264 for attaching to an end of hose (not depicted) where the other end of the hose is attached to a fluid source (not depicted).

In the apparatus 200 depicted in FIGS. 4–11, the parts of the housing 202 are secured to one another by bolts 270, 271, 273, an alignment wall 274 and guide bars 276. The alignment wall 274 is secured to a planar surface 278 of the manifold member 254 by one or more bolt 270 screwed into mating threaded holes in the alignment wall 274. The jet assemblies 203 are placed on the planar surface 278 of the manifold member 254 next to one another, with a planar surface 280 (FIG. 10) of one of the jet assemblies 203 in contact with a planar surface 282 (FIG. 4) of the alignment wall 274, with the longitudinal axes 210 of the yarn passages 208 in the jet assemblies 203 parallel, or substantially parallel, to one another and parallel, or substantially parallel, to the planar surface 282 of the alignment wall 274. Bolts 271 extend through holes 284 (FIG. 10) through the jet assemblies 203 and fasten to threaded holes in the planar surface 282 of the wall 274. Guide rails 276 are positioned in a slot 286 (FIG. 7A and 7B) beneath the guide surface 240 on both ends of the jet assemblies 203. Each guide rail 276 has an inclined surface 288 which joins in a dove tail connection with an inclined surface 290 on each of the jet assemblies 203. One or more bolt 273 secure the manifold member 254 to the guide rails 276 by screwing into mating threaded holes in the guide rails 276. By tightening the bolts 273, the jet assemblies 203 are drawn tight against the manifold member 254 due to the interaction of the inclined surfaces 288 on the guide rails 276 and the inclined surfaces 290 on the jet assemblies 203.

Method Relating to First Inventive Aspect

The first aspect of the invention includes the following method for interlacing filaments. The fluid jet interlace apparatuses 100, 200 in accordance with the first inventive aspect are capable of performing this method. First, yarn 10 is passed through the yarn passage 108, 208 defined by the housing 102, 202, the yarn passage 108, 208 having a cross section perimeter, at least where the fluid inlet passage 106, 206 is connected to the yarn passage 108, 208, having a shape selected from the group consisting of (i) a triangle having three rounded corners each independently with a radius r with r/R of about 0.50 to about 0.90, and preferably of about 0.75 to about 0.85, where R is a radius of a largest inscribed circle within the triangle, and the cross section perimeter being smooth or substantially smooth and having no discontinuities except where the fluid inlet passage 106, 206 is connected to the perimeter 121–123, 208, (ii) a heart, and (iii) a pentagon. Second, a jet of fluid is directed through the fluid inlet passage 106, 206 through the housing 102, 202 into the yarn passage 108, 208 against the yarn 10. Third, periodic nodes 12 are formed along the yarn 10 where the filaments are intermingled with adjacent ones of the filaments and groups of the filaments to maintain unity of the yarn 10 by frictional constraint between the filaments.

Method Relating to Second Inventive Aspect

The second aspect of the invention includes the following method for interlacing filaments. The fluid jet interlace apparatuses 100, 200 in accordance with the second inventive aspect are capable of performing this method. First, yarn 10 is passed through the yarn passage 108, 208 defined by the housing 102, 202. Second, a jet of fluid is directed through the fluid inlet passage 106, 206 through the housing 102, 202 into the yarn passage 108, 208 against the yarn 10. This directing step includes guiding fluid exiting from the yarn passage 108, 208 past the exterior surface 130, 230 defining an end of the non-fluid inlet side 114, 214 of the yarn passage 108, 208. Note, the exterior surface 130, 230 is angled an angle A which is greater than 10° with respect to a longitudinal axis 110, 210 of the yarn passage 108, 208 providing an edge 132, 232 between the yarn passage 108, 208 and the exterior surface 130, 230. Third, the fluid exiting from the yarn passage 108, 208 is drawn away from the longitudinal axis 110, 210 of the yarn passage 108, 208 towards a groove wall 142, 242 in a guide surface 140, 240 of the housing 102, 202. The groove wall 142, 242 is coextensive with a fluid inlet side 112, 212 of the yarn passage 108, 208 which connects with the fluid inlet passage 106, 206. Further, the groove wall 142, 242 diverges (e.g., is angled or arced) away from the longitudinal axis 110, 210 of the yarn passage 108, 208. The drawing step can include drawing fluid within the yarn passage 108, 208 towards the portion 215 of the fluid inlet side 112, 212 of the yarn passage 108, 208 diverging, such as at an angle or arc, away from the longitudinal axis 110, 210 of the yarn passage 108, 208 with distance from the fluid inlet passage 106, 206. Fourth, periodic nodes 12 are formed along the yarn 10 where the filaments are intermingled with adjacent ones of the filaments and groups of the filaments to maintain unity of the yarn 10 by frictional constraint between the filaments.

Method Relating to Third Inventive Aspect

The third aspect of the invention includes the following method for interlacing filaments. The fluid jet interlace apparatus 200 in accordance with the third inventive aspect is capable of performing this method. First, yarn 10 is fed through the string up slot 261 through the housing 202 into the yarn passage 208 in the housing 202. The yarn 10 follows a string up path which: (i) enters the yarn passage 208 along an intersection line which is parallel, or substantially parallel, to the longitudinal axis 210 of the yarn passage 208, (ii) intersects a fluid outlet end of the fluid inlet passage 206 at a distance L from the longitudinal axis 207 of the fluid inlet passage 206 between 0% and 80%, preferably between 25% and 80%, and more preferably from about 50% to about 75%, of a radius r of the fluid inlet passage 206, and (iii) intersects the fluid outlet end of the fluid inlet passage 206 at an angle D greater than 0° to less than 90°, and preferably greater than 20° to less than 40°, with respect to the longitudinal axis 207 of the fluid inlet passage 206. Second, during the feeding step, a jet of fluid is directed through the fluid inlet passage 206 through the housing 202 into the yarn passage 208 against the yarn 10, such that the jet of fluid forces the yarn 10 from the string up slot 261, pushes the yarn 10 into the yarn passage 208, and inhibits the yarn 10 from coming back out the string up slot 261. Third, the yarn 10 is passed through the yarn passage 208. Fourth, periodic nodes 12 are formed along the yarn 10 where the filaments are intermingled with adjacent ones of the filaments and groups of the filaments to maintain unity of the yarn 10 by frictional constraint between the filaments.

Method Relating to Fourth Inventive Aspect

The fourth aspect of the invention comprises a method for making the fluid jet interlace apparatus 100, 200. The first step is forming in the housing 102, 202 such that the chamber 104, 204 is adapted to receive fluid; the fluid inlet passage 106, 206 is connected to receive fluid from the chamber 104, 204; and a pilot passage is connected to receive fluid from the fluid inlet passage 106, 206, the pilot passage having a longitudinal axis (which can become the longitudinal axis 110, 210 of the yarn passage 108, 208). The second step is positioning an electric discharge wire 16 (see FIG. 9) in the pilot passage and passing current through the wire. A third step is providing a dielectric fluid in the pilot passage. Suitable dielectric fluids include kerosene, light mineral oils, etc. A fourth step is eroding the housing 102, 202 by moving the wire with respect to the housing 102, 202 and parallel to, or substantially parallel to, the longitudinal axis of the pilot passage forming the pilot passage into the yarn passage 108, 208 having the selected cross section perimeter shape. The radius of the wire is chosen to be the same or smaller than the smallest radius or curvature needed within the desired cross section of the yarn passage 108, 208.

In accordance with the first aspect of the invention, the cross section perimeter 121–123 , at least where the fluid inlet passage 106 is connected to the yarn passage 108, has a shape that can be selected from the group consisting of (i) a triangle having three rounded corners each independently with a radius r with r/R of about 0.50 to about 0.90, and preferably of about 0.75 to about 0.85, where R is a radius of a largest inscribed circle within the triangle, 208, and the cross section perimeter 121–123 being smooth or substantially smooth and having no discontinuities except where the fluid inlet passage 106, 206 is connected to the perimeter 121–123 , (ii) a heart, and (iii) a pentagon.

In accordance with the second aspect of the invention prior to the forming step, one can provide the housing 102, 202 with the exterior surface 130, 230 and the guide surface 140, 240. Then in the forming step, one can form the pilot passage such that (i) the exterior surface 130, 230 defines at least a portion of an end of the pilot passage and (ii) the exterior surface 130, 230 is angled at an angle B which is greater than 10° with respect to the longitudinal axis of the pilot passage. Further, in the eroding step, the guide surface 140, 240 at a first end of the yarn passage 208 is eroded by moving the wire with respect to the housing 102, 202 and angled in a first direction with respect to the longitudinal axis of the pilot passage forming the fluid guide groove defined by the groove wall 142, 242 coextensive with the fluid inlet side 112, 212 of the yarn passage 108, 208, the groove wall 142, 242 being angled away from the longitudinal axis 110, 210 of the yarn passage 108, 208. Merely angling the wire 16 in an opposition direction to the first direction allows groove walls 242 to be eroded in the guide surface 240 at the other end of the yarn passage 208. A portion 215 at a first end of the fluid inlet side 212 of the yarn passage 208 can be eroded to also be angled away from the longitudinal axis 110, 210 of the yarn passage 108, 208. The portion 215 can be formed by positioning the wire 16 at an angle with respect to the longitudinal axis 210 of the housing 202 such that the wire just contacts without eroding a second end of the non-fluid inlet side 214 of the yarn passage 208, and contacts and erodes the first end of the fluid inlet side 212 of the yarn passage 214. The portion 215 at the other end of the yarn passage 208 can be formed by positioning the wire 16 at an angle to contact without eroding the first end of the non-fluid inlet side 214 of the yarn passage 208, and to contact and erode the second end of the fluid inlet side 212 of the yarn passage 208.

In accordance with the third aspect of the invention, the method would include eroding the housing 202 with an electric discharge wire by passing current through the wire and moving the wire to form the string up slot 261 having an internal opening with a center plane 267 which (i) intersects the yarn passage 208 along an intersection line which is parallel, or substantially parallel, to the longitudinal axis 210 of the yarn passage 208, (ii) intersects a fluid outlet end of the fluid inlet passage 206 at a distance L from the longitudinal axis 207 of the fluid inlet passage 206 between 0% and 80% of a radius r of the fluid inlet passage 206, and (iii) intersects the fluid outlet end of the fluid inlet passage 206 at an angle D greater than 0° to less than 90° with respect to the longitudinal axis 207 of the fluid inlet passage 206. The wire for this step is chosen to be the same or smaller than the smallest radius or curvature needed to form the string up slot 261. As a result, the radius of the wire in this step is less than the radius of the wire for forming the yarn passage 208.

TEST METHODS

The following test methods were used in the following Examples.

Relative viscosity (RV) of nylons refers to the ratio of solution or solvent viscosities measured in a capillary viscometer at 25° C. (ASTM D 789). The solvent is formic acid containing 10% by weight water The solution is 8.4% by weight polymer dissolved in the solvent.

Denier (ASTM D 1577) is the linear density of a fiber as expressed as weight in grams of 9000 meters of fiber. The denier is measured on a Vibroscope from Textechno of Munich, Germany. Denier times (10/9) is equal to decitex (dtex). Denier tests performed on samples of fibers were at standard temperature and relative humidity conditions prescribed by ASTM methodology. Specifically, standard conditions mean a temperature of 70±2° F. (21±1° C.) and relative humidity of 65%±2%.

Interlace measurement was performed according to the ASTM standard method designated D4724-87 (Reapproved 1992). The ASTM D4724 protocol covers the common procedures for determination of the degree of filament yarn entanglement using needle insertion. The yarn entanglement determination methods herein are adapted for the measurement of the degree of filament entanglement in a length of yarn. The interlace results are reported in nodes per meter (n/m).

The yarn interlace is determined by first interlacing the yarn and then winding it up on a tube into a package. The end of the yarn on the surface of the package is then threaded through the automatic entanglement tester and is pulled through the tester continuously as the interlace measurements are being made and the yarn is being unwound from the package. It is believed that the direction the yarn is traveling through the tester relative to the direction the yarn was traveling when interlace was applied is irrelevant in determining interlace level.

The yarn interlace determination method is made on a moving yarn under a controlled pretension called the "trip force" (tf) which are reported in grams of force (Newtons). First, a yarn sample package is selected for testing. Typically, this yarn package is taken directly from the yarn spinning position and submitted to the automatic entanglement tester without conditioning the yarn. The sample yarn is strung on the entanglement tester automatically from the yarn package. Under a predetermined yarn tension of 5 grams±0.5 grams, the sample is transported at about 30 cm/second. Automatically, a pin on a rotatable grooved wheel is inserted into the yarn at random. When an interlace node strikes the inserted pin, the tension on the moving yarn is increased by the encounter with the node. This tension increase is sensed by a tensiometer and relayed to a microprocessor programmed to respond to a variable trip tension. The trip force tension is preselected and based upon sample yarn denier. Exceeding the trip force tension signals for rotation of the grooved wheel. The grooved wheel rotation removes the inserted pin from the moving yarn and reinserts the pin into the moving yarn at another random location. The interception of another interlace node repeats this cycle. The distance of yarn travel between successive pin insertion and node intercept (preset tension rise) is measured and recorded by the microprocessor of the entanglement tester.

A sufficiently large data set is recorded for one yarn sample to provide an accurate estimate of statistical variations in the measurement, as provided by the standard deviation (std. dev.) of the measurement. Typically, the number of nodes measured is 20. Fewer than 15 nodes measured may give non-representative results and more than 25 nodes measured typically provides no further statistical improvement to the results.

Next, for some of the Examples, the trip force tension is increased and the measurement repeated on the moving yarn. The interlace measurement on another portion of the same yarn sample (i.e., package) at a higher trip force tension is indicative of the strength and stability of the entanglement points.

Another interlace test is then performed for some of the Examples after the yarn is subjected to tensions that can be found in use to thereby determine how much interlace can be lost due to normal yarn handling. In order to perform this test, the yarn is unwound from the original package under an elevated tension and rewound into another package, commonly called a back-wound package, in a process called backwinding. The yarn from the back-wound package is then threaded through the automatic entanglement tester. The back-wound yarn sample is then measured, usually at the first selected trip force tension level, for interlace as previously done. These measurements on back-wound yarn are indicative of how easily the yarn entanglement nodes are pulled out by tension the yarn may experience during processes like weaving.

EXAMPLES

This invention will now be illustrated by the following specific examples. Examples prepared according to the process or processes of the current invention are indicated by numerical values. Control or Comparative Examples are indicated by letters.

Example 1

This is an example of the first aspect of the invention and the second aspect of the invention. An interlace jet apparatus was used as illustrated in FIGS. 1, 2 and 3A with yarn passage cross section perimeters in the shape of a triangle with three rounded corners (R-triangle) where the fluid inlet passage intersected the yarn passage in accordance with the first aspect of the invention. The radius r of each of the rounded corners was 0.025 inches (0.0635 cm) and r/R was 0.82 where R is the radius of the largest inscribed circle within the triangle where the fluid inlet passage intersected the yarn passage. The yarn passage cross section had an area of 2.4 $mm^2$ where the fluid inlet passage intersected the yarn passage and the fluid inlet passage had a diameter of 1.3 mm. In accordance with the second aspect of the invention, the interlace jet apparatus also had exterior surfaces 130 and guide surfaces 140 with groove walls 142 defining grooves as illustrated in FIGS. 1 and 2. The test yarn is a nylon 6,6 homopolymer apparel yarn of 70 denier and 34 filaments. The nylon 6,6 yarn was melt spun from 46 RV (±2 RV) polymer.

Figure 12:
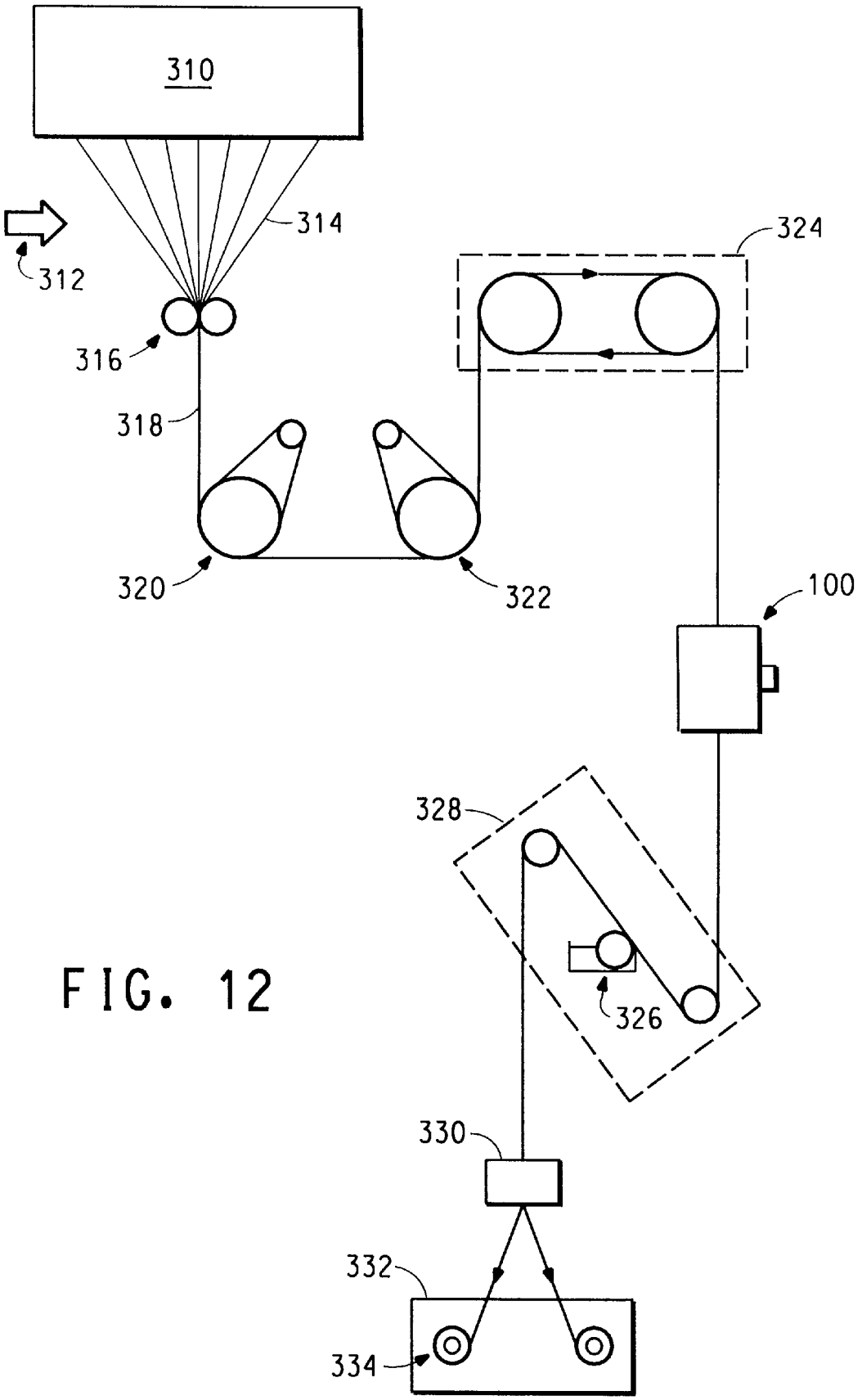
FIG. 12 is a schematic illustration of a first yarn spinning system utilizing the interlacing apparatus of the present invention.

Referring to FIG. 12, the nylon 6,6 yarn was melt spun into filaments 314 from a spinneret 310, quenched in air (represented by arrow 312), converged by a device 316 into a multifilament yarn 318 and forwarded to a feed roll assembly 320 and then a draw roll assembly 322 at 3,018 meters per minute. The drawn filaments were relaxed with heat in a relaxation zone 324 and air jet interlaced by a jet interlace apparatus 100 prior to application of a lubricating finish by an applicator 326. All yarns 318 were interlaced with compressed air at 7 grams tension. The so-treated yarns 318 were forwarded from the interlace jet apparatus 100 by a puller roll tension let down assembly 328 to a fanning guide 330 and packaged by a surface driven wind-up apparatus 332. Four yarn threadlines were spun and interlaced and wound into 4 packages 334 simultaneously for each test. The threadlines were wound up in separate packages. Interlace measurements were made at a series of test pressures for the interlace jet air supply. Each pressure and interlace jet apparatus combination was run for 15 minutes.

For Examples 1–6, and Comparative Examples A and B, the following interlace measurements were made and recorded in the subsequent data Tables. In a first interlace measurement, four successive lengths (200 meters each) on the same threadline were measured at a trip force (tf) of 15 grams (0.147 Newtons). The interlace jet air supply pressure was varied at 8, 18 and 28 pounds per square inch (psi) (55, 124, and 193 kPa) gauge pressure. The results of these measurements are reported as averages in Table 1.

In a second interlace measurement, each of the four threadlines were measured at a trip force (tf) of 15 grams (0.147 Newtons) and at an interlace jet air supply pressure 8, 18 and 28 pounds per square inch (psi) (55, 124, and 193 kPa) gauge pressure. The results of these measurements are reported as averages in Columns III of Table 2–4, respectively, and graphed in FIGS. 13–15.

In a third interlace measurement, each of the four threadlines were measured at a trip force of 45 grams (0.441 Newtons) in order to assess the strength of the interlace nodes. The interlace jet air supply pressure was varied at 8, 18 and 28 pounds per square inch (psi) (55, 124, and 193 kPa) gauge pressure. The results of these measurements are reported as averages in Columns IV of Tables 2–4, respectively, and graphed in FIGS. 13–15.

In a fourth interlace measurement, each of the four threadlines that had been made at 8, 18, and 28 pounds per square inch (psi) (55, 124, and 193 kPa) gauge pressure were back wound (bw) under a tension of 30 grams (0.294 Newtons) onto a yarn package and then measured at a trip force of 15 grams (0.147 Newtons). The results of these measurements are reported as an average in Columns V of Tables 2–4, respectively, and graphed in FIGS. 13–15.

In all cases, interlace measurements are reported in nodes per meter (n/m) along with the standard deviation (std. dev.) of the measurement. The standard deviation reflects the average spread of the data from the mean value which is the usual meaning of standard deviation in statistics. The standard deviation is in units of nodes per meter (n/m).

Example 2

This is an example of the first aspect of the invention and the second aspect of the invention. It used an interlace jet apparatus as illustrated in FIGS. 1, 2 and 3B with yarn passage cross section perimeters in the shape of a heart where the fluid inlet passage intersected the yarn passage in accordance with the first aspect of the invention. The yarn passage cross section had an area of 2.4 $mm^2$ where the fluid inlet passage intersected the yarn passage and the fluid inlet passage had a diameter of 1.3 mm. In accordance with the second aspect of the invention, the interlace jet apparatus also had exterior surfaces 130 and guide surfaces 140 with groove walls 142 defining grooves as illustrated in FIGS. 1 and 2. Yarn was spun according to the Example 1 process and conditions. Yarn collected from each of the four yarn threadlines for this interlace jet apparatus and air pressure combination was measured in exactly the same manner as in Example 1.

Example 3

This is an example of the first aspect of the invention and the second aspect of the invention. It used an interlace jet apparatus as illustrated in FIGS. 1, 2 and 3C with yarn passage cross section perimeter in the shape of a pentagon where the fluid inlet passage intersected the yarn passage in accordance with the first aspect of the invention. The yarn passage cross section had an area of 2.4 mm2 where the fluid inlet passage intersected the yarn passage and the fluid inlet passage had a diameter of 1.3 mm. In accordance with the second aspect of the invention, the interlace jet apparatus also had exterior surfaces 130 and guide surfaces 140 with groove walls 142 defining grooves as illustrated in FIGS. 1 and 2. Yarn was spun according to the Example 1 process and conditions. Yarn collected from each of the four yarn threadlines for this interlace jet and air pressure combination was measured in exactly the same manner in Example 1.

Example 4

Figure 3D:
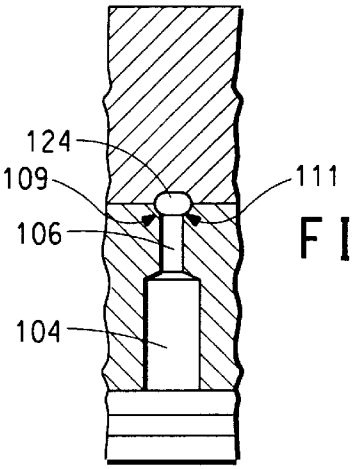

This is an example of the second aspect of the invention in that it tested an interlace jet with exterior surfaces 130 and guide surfaces 140 with groove walls 142 defining grooves as illustrated in FIGS. 1 and 2. It tested an interlace jet apparatus with an oval yarn passage cross section perimeter 124 (as illustrated in FIG. 3D) where the fluid inlet passage intersected the yarn passage. The yarn passage cross section had an area of 2.4 $mm^2$ where the fluid inlet passage intersected the yarn passage and the fluid inlet passage had a diameter of 1.3 mm. Yarn was spun according to the Example 1 process and conditions. Yarn collected from each of the four yarn threadlines for this interlace jet and air pressure combination was measured in exactly the same manner in Example 1.

Example 5

Figure 3E:
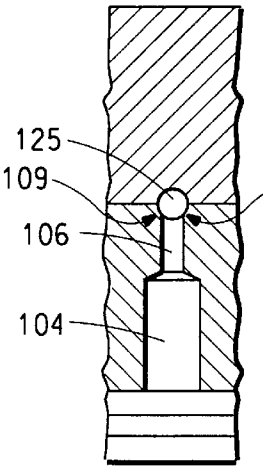
Figure 3F:
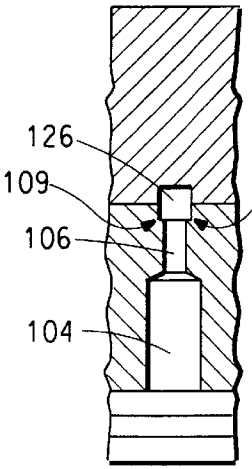
Figure 4:
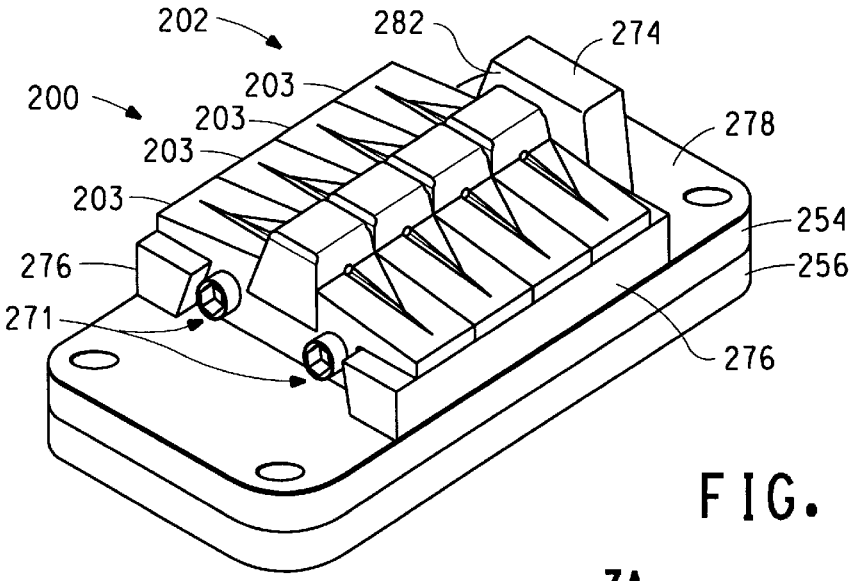
FIG. 4 is a perspective view of a second embodiment of an interlacing apparatus for interlacing filaments into a cohesive yarn in accordance with the invention.
Figure 5:
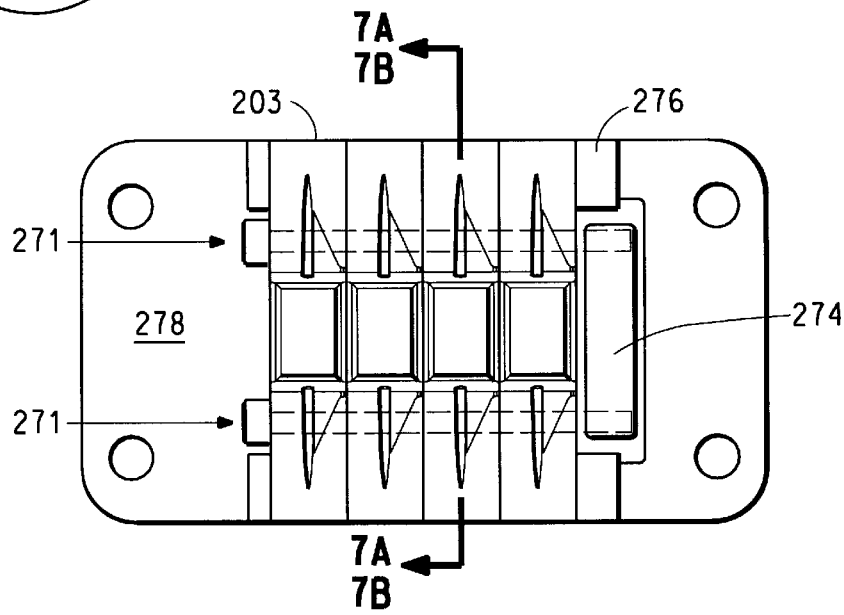
FIG. 5 is a plan view of the interlacing apparatus of FIG. 4.
Figure 6:
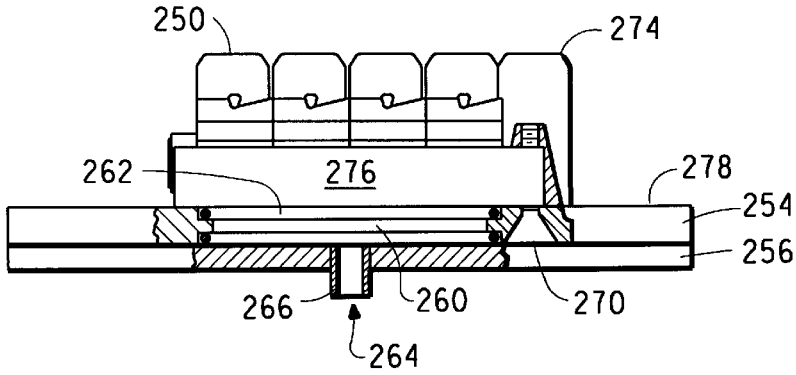
FIG. 6 is a side view of the interlacing apparatus of FIG. 4.

This is an example of the second aspect of the invention in that it tested an interlace jet with exterior surfaces 130 and guide surfaces 140 with groove walls 142 defining grooves as illustrated in FIGS. 1 and 2. It tested an interlace jet apparatus with a square yarn passage cross section perimeter 126 (as shown in FIG. 3F) where the fluid inlet passage intersected the yarn passage. The yarn passage cross section had an area of 2.4 $mm^2$ where the fluid inlet passage intersected the yarn passage and the fluid inlet passage had a diameter of 1.3 mm. Yarn was spun according to the Example 1 process and conditions. Yarn collected from each of the four yarn threadlines for this interlace jet and air pressure combination was measured in exactly the same manner in Example 1.

Example 6

This is an example of the second aspect of the invention in that it tested an interlace jet with exterior surfaces 130 and guide surfaces 140 with groove walls 142 defining grooves as illustrated in FIGS. 1 and 2. It tested an interlace jet with circular (round) yarn passage cross section 125 (as shown in FIG. 3E) where the fluid inlet passage intersected the yarn passage. The yarn passage cross section had an area of 2.4 $mm^2$ where the fluid inlet passage intersected the yarn passage and the fluid inlet passage had a diameter of 1.3 mm. Yarn was spun according to the Example 1 process and conditions. Yarn collected from each of the four yarn threadlines for this interlace jet and air pressure combination was measured in exactly the same manner in Example 1.

Comparative Example A

This example tested a prior art interlace jet apparatus commercially available from Heberlein Maschinenfabrik AG, Heberlein N.A., Inc., P.O. Box 9296, Greenville, S.C. 29604 and designated Heberlein (1.3 mm orifice) PolyJet SP 25-H131/C13. The yarn passage cross section perimeter was shaped like FIG. 10 in U.S. Pat. No. 5,146,660. The yarn passage cross section had an area of 2.4 $mm^2$ where the fluid inlet passage intersected the yarn passage and the fluid inlet passage had a diameter of 1.3 mm. Yarn was spun according to the Example 1 process and conditions. Yarn collected from each of the four yarn threadlines for this interlace jet and air pressure combination was measured in exactly the same manner in Example 1.

Comparative Example B

This example, referred to as a control example, tested a prior art interlace jet apparatus as disclosed in U.S. Pat. No. 5,079,813 (Agers et al.; assigned to DuPont). This interlace jet apparatus is known internally to DuPont as JO140. Each of the fluid inlet passages had a diameter of 0.89 mm. Yarn was spun according to the Example 1 process and conditions. Yarn collected from each of the four yarn threadlines for this interlace jet and air pressure combination was measured in exactly the same manner in Example 1.

Summary of Results of Examples

The data of Table 1 compare the number of interlace nodes per meter produced in threadlines (yarns) at 3 jet air supply pressures. The Table 1 data are averages of measurements on successive lengths of the same yarn and, thus, represent the "along end" uniformity of the yarn. Generally, the number of nodes per meter increase with increasing air supply pressure.

Table 1 shows the following. The Example 1 interlace apparatus (rounded triangle perimeter and Coanda structure) and the Example 2 interlace apparatus (heart perimeter and Coanda structure) were superior to (greater than) (i) the control (Comparative Example B) at all 3 jet pressures and (ii) the Comparative Example A apparatus at 28 psi (193 kPa). The Example 3 interlace apparatus (pentagon perimeter and Coanda structure) was superior to (greater than) the control (Comparative Example B) at all 3 jet pressures. The Example 4 interlace apparatus (oval perimeter and Coanda structure) was superior to (greater than) (i) the control (Comparative Example B) at all 3 jet pressures and (ii) the Comparative Example A apparatus at 8 psi (55 kPa) and at 28 psi (193 kPa). The Example 5 interlace apparatus (square perimeter and Coanda structure) was superior to (greater than) the control (Comparative Example B) at 8 psi (55 kPa). The Example 6 interlace apparatus (round perimeter and Coanda structure) was superior to (greater than) the control (Comparative Example B) at 18 psi (124 kPa).

The data of Tables 2–4 compare the number of interlace nodes per meter produced in yarns at the same 3 air jet pressures and measured at trip forces of 15 grams (0.147 Newtons), 45 grams (0.441 Newtons), and 15 grams (0/147 Newtons) (on samples backwound under tension of 30 grams (0.294 Newtons)). The Table 2–4 data are averages of measurements on different yarns and, thus, represent the uniformity between sets of yarns. The data of Tables 2–4 are graphed in FIGS. 13–15.

Figure 13:
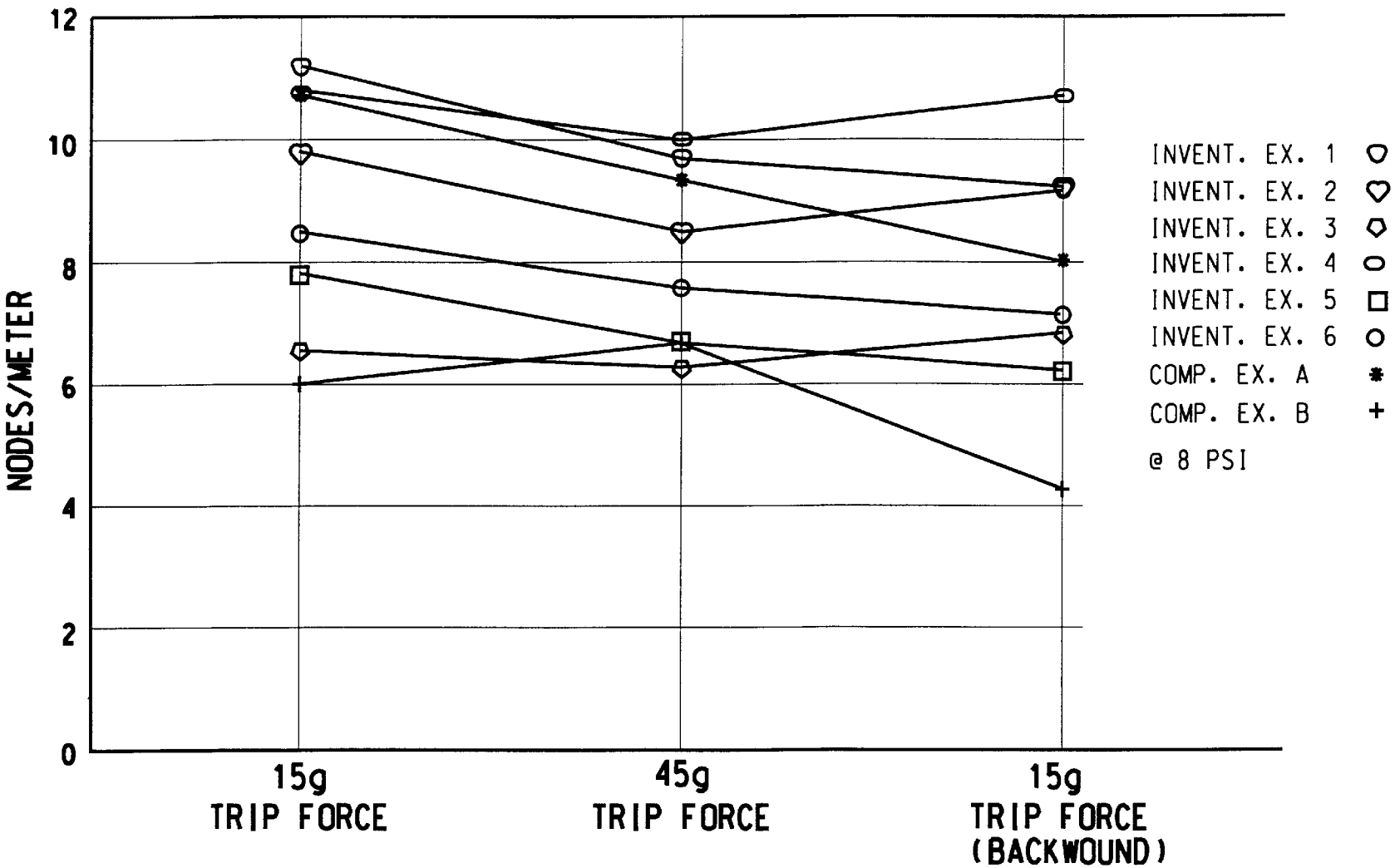
FIGS. 13–15 are graphs of data from the Examples set forth herein.

FIG. 13 depicts the data for 8 psi (55 kPa) and shows the following. All interlace apparatus of the Examples of the invention were superior to (greater than) the control (Comparative Example B) except (i) the Example 3 apparatus (pentagon perimeter and Coanda Structure) was lower than the control at a trip force of 45 grams (0.441 Newtons) and (ii) the Example 5 apparatus (square perimeter and Coanda Structure) was equal or substantially equal to the control at a trip force of 45 grams (0.441 Newtons). The Example 1 apparatus (rounded triangle and Coanda structure), the Example 2 apparatus (heart perimeter and Coanda structure), and the Example 4 apparatus (oval perimeter and Coanda structure) were superior to the Comparative A apparatus at one or more of the measured trip forces.

Figure 14:
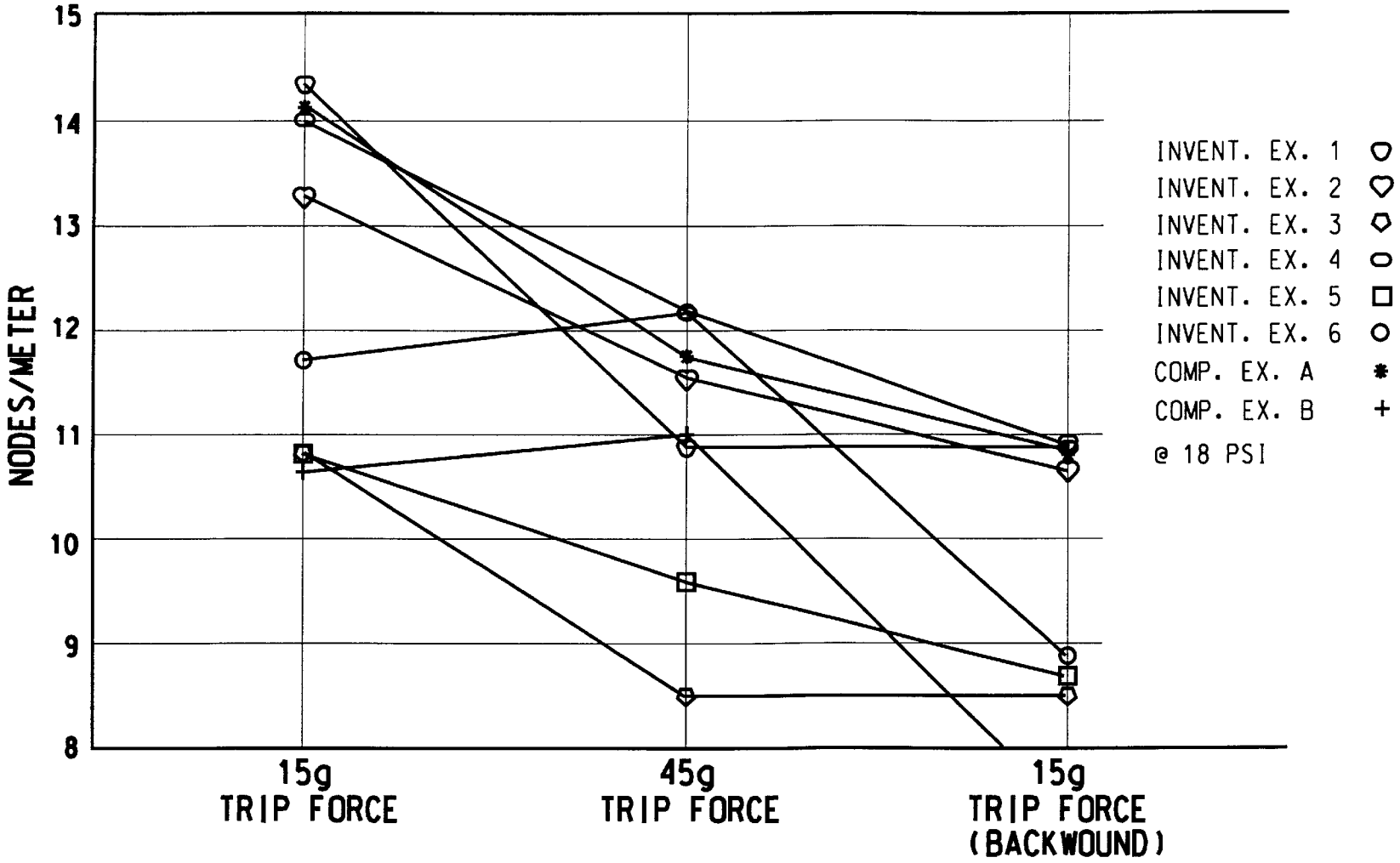

FIG. 14 depicts the data for 18 psi (124 kPa) and shows the following. All interlace apparatus of the Examples of the invention were superior to (greater than) the control (Comparative Example B) except (i) the Example 3 apparatus (pentagon perimeter and Coanda Structure), and the Example 5 apparatus (square perimeter and Coanda structure) were lower than the control at a trip force of 45 grams (0.441 Newtons) and (ii) the Example 1 apparatus (rounded triangle perimeter and Coanda Structure) was substantially equal to the control at a trip force of 45 grams (0.441 Newtons). The Example 1 apparatus (rounded triangle and Coanda structure), the Example 4 apparatus (oval perimeter and Coanda structure), and the Example 6 apparatus (circular perimeter and Coanda structure) were superior to the Comparative A apparatus at one or more of the measured trip forces.

Figure 15:
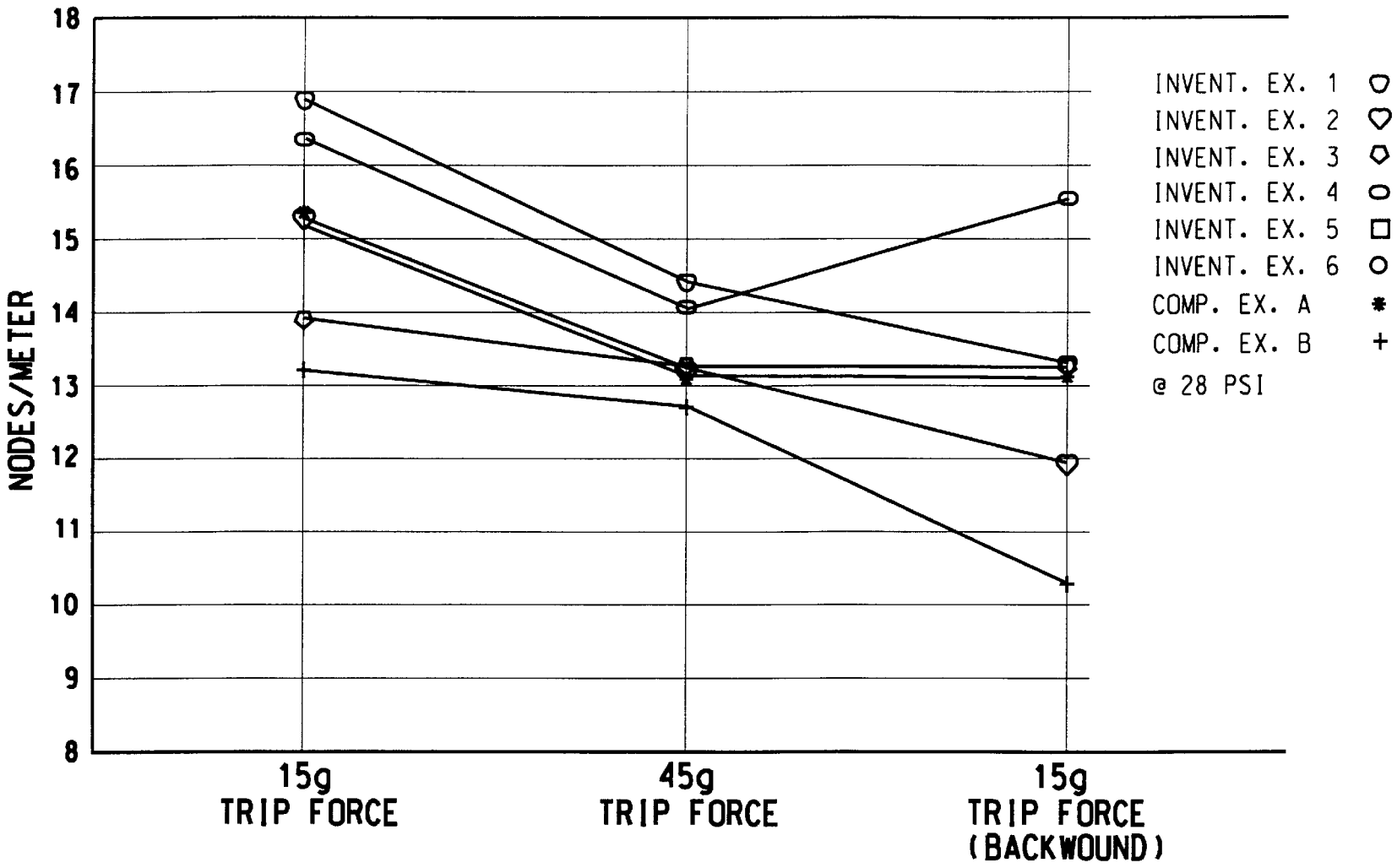

FIG. 15 depicts the data for 28 psi (193 kPa) and shows the following. All interlace apparatus of the Examples of the invention were superior to (greater than) the control (Comparative Example B) at all measured trip forces. The Example 1 apparatus (rounded triangle and Coanda structure) and the Example 4 apparatus (oval perimeter and Coanda structure) were also superior to the Comparative A apparatus at all measured trip forces. Further, the Example 2 apparatus (heart and Coanda structure), the Example 3 apparatus (pentagon perimeter and Coanda structure), the Example 5 apparatus (square perimeter and Coanda structure), and the Example 6 apparatus (circular perimeter and Coanda structure) were substantially the same as the Comparative A apparatus at one or more of the measured trip forces.

TABLE 1

| I Example | II shape | III Interlace (8psi-15tf) & std. dev | IV Interlace (18psi-15tf) & std. dev. | V Interlace (28psi-15tf) & std. dev. |
|---|---|---|---|---|
| 1 | R-triangle | 10.92 n/m<br>1.11 n/m | 13.36 n/m<br>1.29 n/m | 17.10 n/m<br>1.31 n/m |
| 2 | heart | 10.24 n/m<br>1.15 n/m | 13.63 n/m<br>0.54 n/m | 15.68 n/m<br>0.6 n/m |
| 3 | pentagon | 6.94 n/m<br>1.08 n/m | 13.13 n/m<br>1.14 n/m | 13.97 n/m<br>0.96 n/m |
| 4 | oval | 10.92 n/m<br>0.65 n/m | 13.57 n/m<br>0.69 n/m | 16.55 n/m<br>0.88 n/m |
| 5 | square | 7.63 n/m<br>0.78 n/m | 10.70 n/m<br>1.09 n/m | —<br>— |
| 6 | round | —<br>— | 11.84 n/m<br>1.17 n/m | —<br>— |
| A | HEBERLEIN 1.3 mm | 10.39 n/m<br>0.85 n/m | 13.88 n/m<br>0.84 n/m | 15.19 n/m<br>1.13 n/m |
| B | DuPont JO140 | 6.83 n/m<br>2.26 n/m | 11.61 n/m<br>0.26 n/m | 13.85 n/m<br>1.47 n/m |

8 psi-15 tf means the interlace jet air supply pressure was set at 8 pounds per square inch (55 kPa) and the interlace measurement trip force set at 15 grams 0.147 Newtons). 18 psi-15 tf means the interlace jet air supply pressure set at 18 pounds per square inch (124 kPa) and the interlace measurement trip force was set at 15 grams (0.147 Newtons). 28 psi-15 tf means the interlace jet air supply pressure was set at 28 pounds per square inch (193 kPa) and the interlace measurement trip force was set at 15 grams (0.147 Newtons).

TABLE 2

| I Example | II shape | III Interlace (8psi-15tf) & std. dev | IV Interlace (8psi-45tf) & std. dev. | V Interlace (8psi-15tf-bw) & std. dev. |
|---|---|---|---|---|
| 1 | R-triangle | 11.38 n/m<br>0.83 n/m | 9.79 n/m<br>0.59 n/m | 9.1 n/m<br>0.98 n/m |
| 2 | heart | 9.79 n/m<br>0.59 n/m | 8.42 n/m<br>1.42 n/m | 8.99 n/m<br>1.2 n/m |
| 3 | pentagon | 6.49 n/m<br>0.44 n/m | 6.15 n/m<br>1.2 n/m | 6.71 n/m<br>0.68 n/m |
| 4 | oval | 10.81 n/m<br>0.78 n/m | 10.02 n/m<br>0.91 n/m | 10.7 n/m<br>1.08 n/m |
| 5 | square | 7.85 n/m<br>1.31 n/m | 6.49 n/m<br>0.23 n/m | 6.15 n/m<br>1.31 n/m |
| 6 | round | 8.54 n/m<br>0.57 n/m | 7.51 n/m<br>0.79 | 6.94 n/m<br>1.25 n/m |
| A | HEBERLEIN 1.3 mm | 10.67 n/m<br>1.17 n/m | 9.42 n/m<br>0.64 n/m | 7.97 n/m<br>1.10 n/m |
| B | DuPont JO140 | 6.03 n/m<br>0.94 n/m | 6.60 n/m<br>0.27 n/m | 4.1 n/m<br>1.17 n/m |

The following designations as used in Tables 2–4 have the following meanings. 8 psi-15 tf means the interlace jet air supply pressure was set at 8 pounds per square inch (55 kPa) and the interlace measurement trip force was set at 15 grams (0.147 Newtons). 8 psi-45 tf means the interlace jet air supply pressure was set at 8 pounds per square inch (55 kPa) and the interlace measurement trip force was set at 45 grams (0.441 Newtons). 8 psi-15 tf-bw means the interlace jet air supply pressure was set at 8 pounds per square inch (55 kPa) and the interlace measurement trip force was set at 15 grams (0.147 Newtons) and the measurement made after back winding was at 30 grams (0.294 Newtons) yarn tension.

TABLE 3

| I Example | II shape | III Interlace (18psi-15tf) & std. dev | IV Interlace (18psi-45tf) & std. dev. | V Interlace (18psi-15tf-bw) & std. dev. |
|---|---|---|---|---|
| 1 | R-triangle | 14.36 n/m<br>0.75 n/m | 10.93 n/m<br>0.37 n/m | 10.92 n/m<br>1.11 n/m |
| 2 | heart | 13.18 n/m<br>0.79 n/m | 11.49 n/m<br>1.2 n/m | 10.70 n/m<br>0.79 n/m |
| 3 | pentagon | 10.81 n/m<br>1.63 n/m | 8.42 n/m<br>0.27 n/m | 8.42 n/m<br>1.42 n/m |
| 4 | oval | 14.01 n/m<br>1.85 n/m | 12.19 n/m<br>1.40 n/m | 10.81 n/m<br>1.95 n/m |
| 5 | square | 10.81 n/m<br>1.14 n/m | 9.56 n/m<br>1.93 n/m | 8.65 n/m<br>0.74 n/m |
| 6 | round | 11.72 n/m<br>1.01 n/m | 12.15 n/m<br>0.95 n/m | 8.88 n/m<br>1.60 n/m |
| A | HEBERLEIN 1.3 mm | 14.10 n/m<br>0.79 n/m | 11.67 n/m<br>0.67 n/m | 10.84 n/m<br>1.44 n/m |
| B | DuPont JO140 | 10.58 n/m<br>1.41 n/m | 11.04 n/m<br>0.78 n/m | 7.28 n/m<br>1.34 n/m |

TABLE 4

| I Example | II shape | III Interlace (28psi-15tf) & std. dev | IV Interlace (28psi-45tf) & std. dev. | V Interlace (28psi-15tf-bw) & std. dev. |
|---|---|---|---|---|
| 1 | R-triangle | 16.97 n/m<br>0.48 n/m | 14.37 n/m<br>1.12 n/m | 13.38 n/m<br>0.5 n/m |
| 2 | heart | 15.29 n/m<br>0.63 n/m | 13.15 n/m<br>1.38 n/m | 11.95 n/m<br>1.01 n/m |
| 3 | pentagon | 13.91 n/m<br>0.54 n/m | 13.16 n/m<br>0.49 n/m | 13.24 n/m<br>0.37 n/m |
| 4 | oval | 16.35 n/m<br>1.09 n/m | 14.04 n/m<br>1.10 n/m | 15.51 n/m<br>0.65 n/m |
| 5 | square | —<br>— | —<br>— | —<br>— |
| 6 | round | —<br>— | —<br>— | —<br>— |
| A | HEBERLEIN 1.3 mm | 15.17 n/m<br>1.31 n/m | 13.05 n/m<br>0.50 n/m | 13.07 n/m<br>1.01 n/m |
| C | DuPont JO140 | 13.33 n/m<br>2.27 n/m | 12.71 n/m<br>0.66 n/m | 10.13 n/m<br>0.68 n/m |

Example 7

Figure 16:
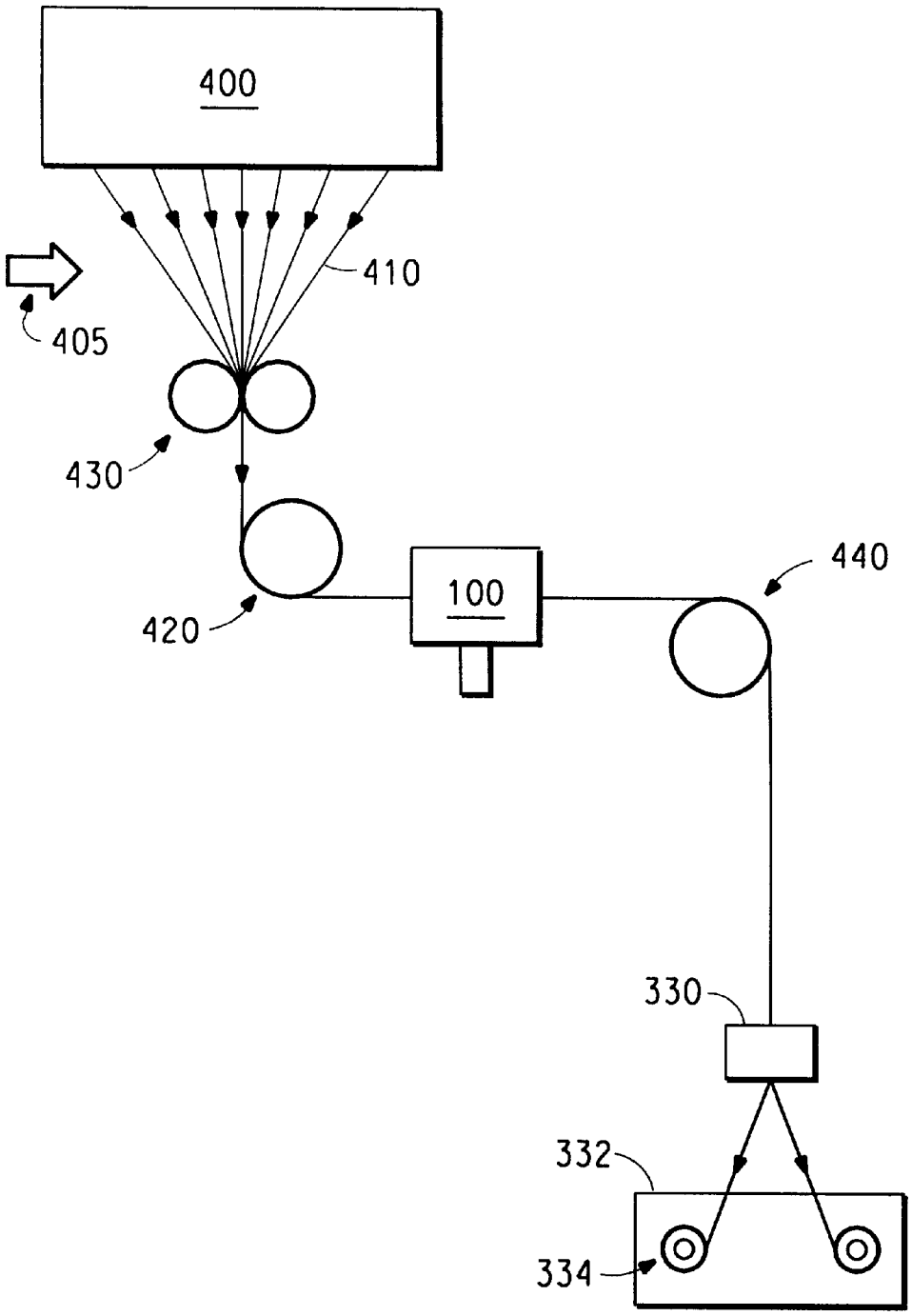
FIG. 16 is a schematic illustration of a second yarn spinning system utilizing the interlacing apparatus of the present invention.

This example of the invention used an interlace jet assembly as illustrated in FIGS. 4–6, 7A, and 8–11 with yarn passage geometry in the shape of a rounded triangle with rounded corners (R-triangle); r/R (d/D) for the yarn passage is 0.8 and the jet orifice is 1.3 mm. The Coanda angle B as in FIG. 9 was 2°. The test yarn is a DACRON® polyester (polyethylene terephthalate homopolymer) apparel yarn of 65 denier and 27 filaments. The DACRON® yarn was melt spun at 2711 meters per minute and interlaced, with compressed air. Two yarn threadlines were spun and interlaced simultaneously for each test. The threadlines were wound up in separate packages. The spinning machine used for preparing the test yarns is illustrated by FIG. 16. The melted DACRON® polyester is extruded into multifilaments 410. The filaments are converged and oiled to form a yarn (threadline) at co-located convergence guide/finish oil applicator 430. The change of direction roll 420 guides the threadline to the interlace jet 100. Change of direction roll 440 guides the interlaced threadline from the interlace jet to fanning guide 330 and to the wind-up apparatus 332 where multiple threadlines are wound into packages 334. The pressure for the interlace jet air supply was fixed at 80 pounds per square inch (psi) (550 kiloPascal) gauge pressure. In a first interlace measurement, 20 successive lengths on each of two separately spun threadlines were measured at a trip force (tf) of 15 grams. The 20 measurements of interlace nodes per meter for each threadline were averaged. Average interlace measurements for the two threadlines were averaged and reported in nodes per meter (n/m).

Comparative Example C

In this comparative example, the DACRON® yarns tested were spun as in Example 7 using an interlace jet apparatus with yarn passage geometry in the shape of a rounded triangle with rounded corners (R-triangle); r/R (d/D) for the yarn passage is 0.27 and the jet orifice is 1.3 mm. The interlace jet apparatus was the same as the one used in Example 7, but the yarn passage was modified to provide the r/R of 0.27. This modification removed portions 215. The interlace jet air pressure was the same as in Example 7. Two threadlines were collected and measured in exactly the same manner in Example 7. Interlace nodes per meter were averaged for the two threadlines.

A comparison of interlace nodes per meter for the 65 denier DACRON® yarns interlaced with the invention interlace jet apparatus (Example 7) of r/R equal to 0.8 and the Comparative Example C with r/R equal to 0.27 is given in Table 5. A higher level of interlace, more nodes per meter, and therefore superior performance was achieved using the interlace jet apparatus of the invention (r/R =0.8).

Example 8

This example of the invention used the interlace jet apparatus of Example 7. The DACRON® yarns tested were spun as in Example 7 except for the following differences: (a) yarn was 200 denier, 50 filaments, (b) spin speed was 4161 meters per minute, (c) interlace jet pressure was 50 psig (345 kiloPascal), and (d) yarn interlace measurements were made at 25 grams trip force (tf). Twenty (20) measurements of interlace nodes per meter were averaged for a single threadline.

Comparative Example D

In this comparative example, the DACRON® yarns tested were spun as in Example 8 using the same interlace jet apparatus and interlace jet air pressure. r/R (d/D) for the yarn passage was 0.27 and the jet orifice was 1.3 mm. The interlace jet apparatus was the same as the one used in Example 7, but the yarn passage was modified to provide the r/R of 0.27. This modification removed portions 215. A single threadline was collected and measured in exactly the same manner in Example 8.

A comparison of interlace nodes per meter for the 200 denier DACRON® yarns interlaced with the invention interlace jet apparatus (Example 8) of r/R equal to 0.8 and the Comparative Example D with r/R equal to 0.27 is given in Table 5. A higher level of interlace, more than twice the number of nodes per meter versus the Comparative Example D, and therefore superior performance was achieved using the interlace jet apparatus of the invention (r/R =0.8).

TABLE 5

| ITEM | POLYMER | YARN COUNT | THREADLINE Average nodes/meter |
|---|---|---|---|
| Example 7 | DACRON ® | 65 denier, 27 filaments | 32.4 |
| Comparative Example C | DACRON ® | 65 denier, 27 filaments | 23.2 |
| Example 8 | DACRON ® | 200 denier, 100 filaments | 15.0 |
| Comparative Example D | DACRON ® | 200 denier, 100 filaments | 7.0 |

What is claimed is:

1. An apparatus for interlacing filaments into a yarn with the filaments intermingled with adjacent ones of the filaments and groups of the filaments to maintain unity of the yarn by frictional constraint between the filaments at periodic nodes along the yarn, comprising:

a housing defining:

a chamber adapted to receive fluid;

a fluid inlet passage connected to receive fluid from the chamber; and a yarn passage connected to receive fluid from the fluid inlet passage, the yarn passage having a cross section perimeter, at least where the fluid inlet passage is connected to the yarn passage, having a shape selected from the group consisting of (i) a triangle having three rounded corners each independently with a radius r with r/R of about 0.50 to about 0.90 where R is a radius of a largest inscribed circle within the triangle, and the cross section perimeter being smooth or substantially smooth and having no discontinuities except where the fluid inlet passage is connected to the perimeter, (ii) a heart, and (iii) a pentagon.

2. The apparatus of claim 1, wherein the housing comprises:

a body defining the chamber and a dovetail groove; and a cap defining the fluid inlet passage, the yarn passage and a mating dovetail projection for insertion into the dovetail groove to hold the body and the cap together.

3. The apparatus of claim 2, further comprising:

a plurality of assemblies, each of the assemblies comprising one of the caps and one of the bodies, the yarn passages in the assemblies arranged parallel or substantially parallel to one another.

4. The apparatus of claim 1, wherein:

the housing having:

an exterior surface defining an end of a non fluid inlet side of the yarn passage, the exterior surface being angled greater than 10° with respect to a longitudinal axis of the yarn passage providing an edge between the yarn passage and the exterior surface; and a guide surface having a groove wall defining a fluid guide groove, the groove wall coextensive with a fluid inlet side of the yarn passage, the groove wall diverging away from the longitudinal axis of the yarn passage, whereby fluid exiting the yarn passage flows away from the exterior surface and travels close to the groove wall thereby being drawn away from the longitudinal axis of the yarn passage.

5. The apparatus of claim 4, wherein:

the groove wall having a length at least about 3 times a diameter of the fluid inlet passage where the fluid inlet passage connects with the yarn passage.

6. The apparatus of claim 1, wherein the housing further defining a string up slot having an internal opening with a center plane which (i) intersects the yarn passage along an intersection line which is parallel, or substantially parallel, to the longitudinal axis of the yarn passage, (ii) intersects a fluid outlet end of the fluid inlet passage at a distance from the longitudinal axis of the fluid inlet passage between 0% and 80% of a radius of the fluid inlet passage, and (iii) intersects the fluid outlet end of the fluid inlet passage at an angle greater than 0° to less than 90° with respect to the longitudinal axis of the fluid inlet passage.

7. The apparatus of claim 6, wherein the string up slot includes an angled portion wherein the slot center plane changes direction by at least about 60° and the angled portion does not intersect the fluid inlet passage.

8. A method for interlacing filaments into a yarn with the filaments intermingled with adjacent ones of the filaments and groups of the filaments to maintain unity of the yarn by frictional constraint between the filaments at periodic nodes along the yarn, comprising:

passing the yarn through a yarn passage defined by a housing, the yarn passage having a cross section perimeter, at least where the fluid inlet passage is connected to the yarn passage, having a shape selected from the group consisting of (i) a triangle having three rounded corners each independently with a radius r with r/R of about 0.50 to about 0.90 where R is a radius of a largest inscribed circle within the triangle, and the cross section perimeter being smooth or substantially smooth and having no discontinuities except where the fluid inlet passage is connected to the perimeter, (ii) a heart, and (iii) a pentagon;

directing a jet of fluid through the fluid inlet passage through the housing into the yarn passage against the yarn; and forming periodic nodes along the yarn where the filaments are intermingled with adjacent ones of the filaments and groups of the filaments to maintain unity of the yarn by frictional constraint between the filaments.

9. The method of claim 8, wherein:

the directing step includes guiding fluid exiting from the yarn passage past an exterior surface of the housing which is angled greater than 10° with respect to a longitudinal axis of the yarn passage providing an edge between the yarn passage and the exterior surface; and further comprising:

drawing the fluid exiting from the yarn passage away from the exterior surface, and away from the longitudinal axis of the yarn passage, towards a groove wall in a guide surface of the housing, the groove wall coextensive with a fluid inlet side of the yarn passage which connects with the fluid inlet passage, the groove wall diverging away from the longitudinal axis of the yarn passage with distance from the yarn passage.

10. The method of claim 8, further comprising:

prior to the passing step, feeding the yarn through a string up slot through the housing into the yarn passage, such that the yarn follows a string up path which:

(i) enters the yarn passage along an intersection line which is parallel, or substantially parallel, to the longitudinal axis of the yarn passage, (ii) intersects a fluid outlet end of the fluid inlet passage at a distance from the longitudinal axis of the fluid inlet passage between 0% and 80% of a radius of the fluid inlet passage, and (iii) intersects the fluid outlet end of the fluid inlet passage at an angle greater than 0° to less than 90° with respect to the longitudinal axis of the fluid inlet passage, such that the jet of fluid forces the yarn from the thread up slot, pushes the yarn into the yarn passage, and inhibits the yarn from coming back out the thread up slot.

11. An apparatus for interlacing filaments into a yarn with the filaments intermingled with adjacent ones of the filaments and groups of the filaments to maintain unity of the yarn by frictional constraint between the filaments at periodic nodes along the yarn, comprising:

a housing having:

a chamber adapted to receive fluid;

a fluid inlet passage connected to receive fluid from the chamber;

a yarn passage connected to receive fluid from the fluid inlet passage, the yarn passage having a fluid inlet side which connects with the fluid inlet passage and a non fluid inlet side opposed to the fluid inlet side;

an exterior surface defining an end of the non fluid inlet side of the yarn passage, the exterior surface being angled greater than 10° with respect to a longitudinal axis of the yarn passage providing an edge between the yarn passage and the exterior surface; and a guide surface having a groove wall defining a fluid guide groove, the groove wall coextensive with the fluid inlet side of the yarn passage, the groove wall diverging away from the longitudinal axis of the yarn passage, whereby fluid exiting the yarn passage flows away from the exterior surface and travels close to the groove wall thereby being drawn away from the longitudinal axis of the yarn passage.

12. The apparatus of claim 11, wherein the housing comprises:

a body defining the chamber and a dovetail groove; and a cap defining the fluid inlet passage, the yarn passage and a mating dovetail projection for insertion into the dovetail groove to hold the body and the cap together.

13. The apparatus of claim 12, further comprising:

a plurality of assemblies, each of the assemblies comprising one of the caps and one of the bodies, the yarn passages in the assemblies arranged parallel or substantially parallel to one another.

14. The apparatus of claim 11, wherein:

the fluid inlet side of the yarn passage having a portion diverging away form the longitudinal axis of the yarn passage with distance from the fluid inlet passage.

15. The apparatus of claim 11, wherein:

the groove wall having a length at least about 3 times a diameter of the fluid inlet passage where the fluid inlet passage connects with the yarn passage.

16. The apparatus of claim 11, wherein the housing further defining a string up slot having an internal opening with a center plane which (i) intersects the yarn passage along an intersection line which is parallel, or substantially parallel, to the longitudinal axis of the yarn passage, (ii) intersects a fluid outlet end of the fluid inlet passage at a distance from the longitudinal axis of the fluid inlet passage between 0% and 80% of a radius of the fluid inlet passage, and (iii) intersects the fluid outlet end of the fluid inlet passage at an angle greater than 0° to less than 90° with respect to the longitudinal axis of the fluid inlet passage.

17. The apparatus of claim 16, wherein the string up slot includes an angled portion wherein the slot center plane changes direction by at least about 60° and the angled portion does not intersect the fluid inlet passage.

18. A method for interlacing filaments into a yarn with the filaments intermingled with adjacent ones of the filaments and groups of the filaments to maintain unity of the yarn by frictional constraint between the filaments at periodic nodes along the yarn, comprising:

passing the yarn through a yarn passage defined by a housing;

directing a jet of fluid through a fluid inlet passage through the housing into the yarn passage against the yarn, the directing step including guiding fluid exiting from the yarn passage past an exterior surface defining an end of a non fluid inlet side of the yarn passage, the exterior surface being angled greater than 10° with respect to a longitudinal axis of the yarn passage providing an edge between the yarn passage and the exterior surface;

drawing the fluid exiting from the yarn passage away from the longitudinal axis of the yarn passage towards a groove wall in a guide surface of the housing, the groove wall coextensive with a fluid inlet side of the yarn passage which connects with the fluid inlet passage, the groove wall diverging away from the longitudinal axis of the yarn passage; and forming periodic nodes along the yarn where the filaments are intermingled with adjacent ones of the filaments and groups of the filaments to maintain unity of the yarn by frictional constraint between the filaments.

19. The method of claim 18, wherein:

the drawing step includes drawing fluid within the yarn passage towards a portion of the fluid inlet side of the yarn passage diverging away from the longitudinal axis of the yarn passage with distance from the fluid inlet passage.

20. The method of claim 18, further comprising:

prior to the passing step, feeding the yarn through a string up slot through the housing into the yarn passage, such that the yarn follows a string up path which:

(i) enters the yarn passage along an intersection line which is parallel, or substantially parallel, to the longitudinal axis of the yarn passage, (ii) intersects a fluid outlet end of the fluid inlet passage at a distance from the longitudinal axis of the fluid inlet passage between 0% and 80% of a radius of the fluid inlet passage, and (iii) intersects the fluid outlet end of the fluid inlet passage at an angle greater than 0° to less than 90° with respect to the longitudinal axis of the fluid inlet passage, such that the jet of fluid forces the yarn from the thread up slot, pushes the yarn into the yarn passage, and inhibits the yarn from coming back out the thread up slot.

21. An apparatus for interlacing filaments into a yarn with the filaments intermingled with adjacent ones of the filaments and groups of the filaments to maintain unity of the yarn by frictional constraint between the filaments at periodic nodes along the yarn, comprising:

a housing defining:

a chamber adapted to receive fluid;

a fluid inlet passage connected to receive fluid from the chamber;

a yarn passage connected to receive fluid from the fluid inlet passage; and a string up slot having an internal opening with a center plane which (i) intersects the yarn passage along an intersection line which is parallel, or substantially parallel, to the longitudinal axis of the yarn passage, (ii) intersects a fluid outlet end of the fluid inlet passage at a distance from the longitudinal axis of the fluid inlet passage between 0% and 80% of a radius of the fluid inlet passage, and (iii) intersects the fluid outlet end of the fluid inlet passage at an angle greater than 0° to less than 90° with respect to the longitudinal axis of the fluid inlet passage.

22. The apparatus of claim 21, wherein the housing comprises:

a body defining the chamber and a dovetail groove; and a cap defining the fluid inlet passage, the yarn passage and a mating dovetail projection for insertion into the dovetail groove to hold the body and the cap together.

23. The apparatus of claim 22, further comprising:

a plurality of assemblies, each of the assemblies comprising one of the caps and one of the bodies, the yarn passages in the assemblies arranged parallel or substantially parallel to one another.

24. The apparatus of claim 21, wherein:

the center plane intersects the fluid outlet end of the fluid inlet passage at a distance from the longitudinal axis of the fluid inlet passage between 50% and 75% of a radius of the fluid inlet passage.

25. The apparatus of claim 21, wherein:

the center plane intersects the fluid outlet end of the fluid inlet passage at an angle greater than 20° to less than 40° with respect to the longitudinal axis of the fluid inlet passage.

26. The apparatus of claim 21, wherein:

the yarn passage having a cross section perimeter, at least where the fluid inlet passage is connected to the yarn passage, having a shape selected from the group consisting of (i) a triangle having three rounded corners each independently with a radius r with r/R of about 0.50 to about 0.90 where R is a radius of a largest inscribed circle within the triangle, and the cross section perimeter being smooth or substantially smooth and having no discontinuities except where the fluid inlet passage is connected to the perimeter, (ii) a heart, and (iii) a pentagon.

27. The apparatus of claim 21, wherein the string up slot includes an angled portion wherein the slot center plane changes direction by at least about 60° and the angled portion does not intersect the fluid inlet passage.

28. A method for interlacing filaments into a yarn with the filaments intermingled with adjacent ones of the filaments and groups of the filaments to maintain unity of the yarn by frictional constraint between the filaments at periodic nodes along the yarn, comprising:

feeding the yarn through a string up slot through a housing into a yarn passage in the housing, such that the yarn follows a string up path which:

(i) enters the yarn passage along an intersection line which is parallel, or substantially parallel, to a longitudinal axis of the yarn passage, (ii) intersects a fluid outlet end of a fluid inlet passage at a distance from a longitudinal axis of the fluid inlet passage between 0% and 80% of a radius of the fluid inlet passage, and (iii) intersects the fluid outlet end of the fluid inlet passage at an angle greater than 0° to less than 90° with respect to the longitudinal axis of the fluid inlet passage;

during the feeding step, directing a jet of fluid through the inlet passage through the housing into the yarn passage against the yarn, such that the jet of fluid forces the yarn from the thread up slot, pushes the yarn into the yarn passage, and inhibits the yarn from coming back out the thread up slot;

passing the yarn through the yarn passage; and forming periodic nodes along the yarn where the filaments are intermingled with adjacent ones of the filaments and groups of the filaments to maintain unity of the yarn by frictional constraint between the filaments.

29. The method of claim 28, wherein:

the feeding step includes feeding the yarn through the string up slot through the housing into the yarn passage in the housing, such that the yarn follows a string up path which intersects the fluid outlet end of the fluid inlet passage at a distance from the longitudinal axis of the fluid inlet passage between 50% and 75% of a radius of the fluid inlet passage.

30. The method of claim 28, wherein:

the feeding step includes feeding the yarn through the string up slot through the housing into the yarn passage in the housing, such that the yarn follows a string up path which intersects the fluid outlet end of the fluid inlet passage at an angle greater than 20° to less than 40° with respect to the longitudinal axis of the fluid inlet passage.

31. A method for making an apparatus for interlacing filaments into a yarn with the filaments intermingled with adjacent ones of the filaments and groups of the filaments to maintain unity of the yarn by frictional constraint between the filaments at periodic nodes along the yarn, comprising:

forming in a housing:

a chamber adapted to receive fluid;

a fluid inlet passage connected to receive fluid from the chamber; and a pilot passage connected to receive fluid from the fluid inlet passage, the pilot passage having a longitudinal axis;

positioning an electric discharge wire in the pilot passage and passing current through the wire;

providing a dielectric fluid in the pilot passage; and eroding the housing by moving the wire with respect to the housing and parallel to, or substantially parallel to, the longitudinal axis of the pilot passage forming the pilot passage into a yarn passage having a cross section perimeter, at least where the fluid inlet passage is connected to the yarn passage, having a shape selected from the group consisting of (i) a triangle having three rounded corners each independently with a radius r with r/R of about 0.50 to about 0.90 where R is a radius of a largest inscribed circle within the triangle, and the cross section perimeter being smooth or substantially smooth and having no discontinuities except where the fluid inlet passage is connected to the perimeter, (ii) a heart, and (iii) a pentagon.

32. The method of claim 31, further comprising:

prior to the forming step, providing the housing with an exterior surface and a guide surface;

in the forming step, forming the pilot passage such that (i) the exterior surface defines at least a portion of an end of the pilot passage and (ii) the exterior surface is angled greater than 10° with respect to the longitudinal axis of the pilot passage; and in the passing step, eroding the guide surface by moving the wire with respect to the housing and angled with respect to the longitudinal axis of the pilot passage forming a fluid guide groove defined by a groove wall coextensive with a fluid inlet side of the yarn passage, the groove wall being angled away from a longitudinal axis of the yarn passage.

33. The method of claim 31, further comprising:

eroding the housing with an electric discharge wire by passing current through the wire and moving the wire to form a string up slot having an internal opening with a center plane which (i) intersects the yarn passage along an intersection line which is parallel, or substantially parallel, to a longitudinal axis of the yarn passage, (ii) intersects a fluid outlet end of the fluid inlet passage at a distance from the longitudinal axis of the fluid inlet passage between 0% and 80% of a radius of the fluid inlet passage, and (iii) intersects the fluid outlet end of the fluid inlet passage at an angle greater than 0° to less than 90° with respect to the inlet passage.

* * * * *